US007577389B2

(12) United States Patent
Ishii et al.

(10) Patent No.: US 7,577,389 B2
(45) Date of Patent: Aug. 18, 2009

(54) HEAT TRANSFER DEVICE OF A IMAGE FORMING DEVICE

(75) Inventors: Kunihiko Ishii, Osaka (JP); Kikunosuke Tsuji, Osaka (JP); Hideki Kitagawa, Osaka (JP); Kazuhisa Edahiro, Osaka (JP); Teruyuki Miyamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/945,304

(22) Filed: Nov. 27, 2007

(65) Prior Publication Data

US 2008/0080911 A1 Apr. 3, 2008

Related U.S. Application Data

(63) Continuation of application No. 10/904,771, filed on Nov. 29, 2004, now Pat. No. 7,319,839.

(30) Foreign Application Priority Data

Nov. 28, 2003 (JP) ..... 2003-400247
Dec. 25, 2003 (JP) ..... 2003-429350

(51) Int. Cl.
*G03G 15/08* (2006.01)
*G03G 15/20* (2006.01)

(52) U.S. Cl. ..... 399/328; 399/122; 399/329; 399/330

(58) Field of Classification Search ..... 399/328, 399/329, 330, 333, 122, 67, 69, 334
See application file for complete search history.

(56) References Cited

U.S. PATENT DOCUMENTS 5,950,060 A * 9/1999 Isogai ..... 399/324
6,574,449 B2 * 6/2003 Yoda et al. ..... 399/329
6,985,689 B2 * 1/2006 Nanataki et al. ..... 399/330
2003/0091360 A1 * 5/2003 Onodera et al. ..... 399/69
2004/0022552 A1 * 2/2004 Yura et al. ..... 399/69
2005/0226660 A1 * 10/2005 Fuma ..... 399/328

FOREIGN PATENT DOCUMENTS

| | | | |
|---|---|---|---|
| JP | 52-017031 | | 2/1977 |
| JP | 56-36674 | | 4/1981 |
| JP | 60-227276 | | 11/1985 |
| JP | 04273274 | A * | 9/1992 |
| JP | 06318001 | A * | 11/1994 |
| JP | 07092843 | A * | 4/1995 |
| JP | 10000698 | A * | 1/1998 |
| JP | A-H11-84934 | * | 3/1999 |
| JP | 2002-6658 | | 1/2002 |
| JP | 2002-311751 | | 10/2002 |
| JP | 2003-122185 | | 4/2003 |
| JP | 2003114583 | A * | 4/2003 |
| JP | 2003241563 | A * | 8/2003 |

* cited by examiner

*Primary Examiner*—David M Gray
*Assistant Examiner*—Joseph S Wong
(74) *Attorney, Agent, or Firm*—Shinjyu Global IP

(57) ABSTRACT

A fixing device is disclosed that includes a fixing roller, a pressure roller that is in pressure contact with the fixing roller, a plurality of belt support rollers that are mutually spaced apart from each other, and an endless belt that is wrapped around the belt support rollers. A portion of the outer peripheral surface of the endless belt is in pressure contact with a portion of the outer peripheral surface of the fixing roller, and the endless belt is heated by at least one heat generating element arranged in at least one of the belt support rollers. The fixing roller is rotatively driven by the electric motor M.

14 Claims, 21 Drawing Sheets

HEAT TRANSFER DEVICE OF A IMAGE FORMING DEVICE

CROSS-REFERENCE TO RELATED APPLICATIONS

This application is a continuation application of U.S. patent application Ser. No. 10/904,771, now allowed, filed on Nov. 29, 2004. The entire disclosure of U.S. patent application Ser. No. 10/904,771 is hereby incorporated herein by reference.

This application claims priority to Japanese Patent Application Nos. 2003-400247 and 2003-429350. The entire disclosure of Japanese Patent Application Nos. 2003-400247 and 2003-429350 are hereby incorporated herein by reference.

BACKGROUND OF THE INVENTION

1. Field of the Invention

The present invention relates to a fixing device that is mounted on an image forming device such as an electrostatic copying machine, printer, facsimile, or the like, and which melts and fixes unfixed toner to paper.

2. Background Information

A fixing device known in the prior art is configured so that a fixing roller is heated from the exterior thereof rather than the interior thereof. This type of fixing device generally includes a fixing roller, a pressure roller that is in pressure contact with the fixing roller, and a plurality of heat rollers that are in pressure contact with the fixing roller and have heating means installed therein. The fixing roller includes a core bar that is a hollow tube made of iron, and a silicone rubber that covers the periphery of the core bar. Each heat roller includes a hollow tube made of aluminum whose surface is coated with a fluoropolymer.

This fixing device can shorten the time needed to warm up the fixing roller because the surface of the fixing roller is directly heated, and thus the total warm up time of the fixing device can be shortened. However, the supply of heat to the fixing roller by the plurality of heat rollers will be limited by the small nip width between each heat roller and the fixing roller, and thus the amount of heat supplied will be limited. As a result, it will be necessary to widen the nip width in the event that one wants to further shorten the warm up time of the fixing roller. However, when the nip width is widened, the localized load on the fixing roller will increase, and thus it will be necessary to increase the drive torque of the fixing roller and strengthen the drive system. In addition, damage to the silicone rubber of the fixing roller may accelerate, and thus durability may be harmed.

An object of the present invention is to provide a novel fixing device that will not increase the localized burden on the fixing roller, not harm the durability of the fixing roller, and shorten the time needed to warm up the fixing roller and thus shorten the total warm up time of the fixing device.

SUMMARY OF THE INVENTION

According to one aspect of the present invention, a fixing device according to the present invention includes a fixing roller, a pressure roller that is in pressure contact with the fixing roller, first and second belt support rollers that are mutually spaced apart from each other, and an endless belt that is wrapped around both the first and the second belt support rollers. A portion of the outer peripheral surface of the endless belt is in pressure contact with a portion of the outer peripheral surface of the fixing roller, and the endless belt is heated by means of a heating means.

According to another aspect of the present invention, the heating means is a heater that is arranged in the interior of at least one of the first and second belt support rollers.

According to yet another aspect of the present invention, the heating means is an excitation coil for electromagnetic induction heating that is arranged across a gap from the outer peripheral surface of the first belt support roller, and arranged so as to cover at least a portion of the outer peripheral surface of the first belt support roller.

According to yet another aspect of the present invention, the first belt support roller and/or the endless belt are/is formed from metal.

According to yet another aspect of the present invention, the heater is arranged in at least the first belt support roller, and the first belt support roller is preferably in pressure contact with the fixing roller via the endless belt.

According to yet another aspect of the present invention, the first belt support roller is arranged in the uppermost upstream position in the rotational direction of the fixing roller, in a nip region of the endless belt that is formed by a portion of the outer peripheral surface of the endless belt being in pressure contact with a portion of the outer periphery of the fixing roller.

According to yet another aspect of the present invention, the heater is arranged in at least the second belt support roller, and the second belt support roller is in pressure contact with the fixing roller via the endless belt. The second support roller is arranged in the lowermost downstream position in the rotational direction of the fixing roller, in a nip region of the endless belt that is formed by a portion of the outer peripheral surface of the endless belt in pressure contact with a portion of the outer periphery of the fixing roller.

According to yet another aspect of the present invention, at least one of the first and second belt support rollers is rotatively driven by the fixing roller via the endless belt.

According to yet another aspect of the present invention, the first and the second belt support rollers are in pressure contact with the fixing roller via the endless belt.

According to yet another aspect of the present invention, the first and the second belt support rollers are rotatively driven by the fixing roller via the endless belt.

According to yet another aspect of the present invention, the first and the second belt support rollers are respectively arranged across a gap from the outer peripheral surface of the fixing roller on upstream and downstream sides of the fixing roller in the rotational direction, and the portion of the outer peripheral surface of the endless belt that is in pressure contact with the portion of the outer peripheral surface of the fixing roller is arranged between the first and second belt support rollers.

According to yet another aspect of the present invention, the first and the second belt support rollers are rotatively driven by the fixing roller via the endless belt.

According to yet another aspect of the present invention, the heating means is installed in the fixing roller or both the fixing roller and the pressure roller.

According to yet another aspect of the present invention, a plurality of projections are formed on the outer peripheral surface of the endless belt.

According to yet another aspect of the present invention, a control device that serves to control the temperature of the heating means is arranged in a space defined by the endless belt and the first and second belt support rollers.

According to yet another aspect of the present invention, the fixing roller is linked to a drive source and rotatively driven by the drive source, and one of the first and second belt support rollers is directly or indirectly linked to the fixing roller and rotatively driven by the fixing roller.

According to yet another aspect of the present invention, the fixing roller is linked to a drive source and rotatively driven by the drive source, and one of the first and second belt support rollers is linked to the drive source and rotatively driven by the drive source.

According to yet another aspect of the present invention, the fixing roller is linked to a first drive source and rotatively driven by the first drive source, and one of the first and second belt support rollers is linked to a second drive source and rotatively driven by the second drive source.

According to yet another aspect of the present invention, the one rotatively driven belt support roller is rotatively driven so that the peripheral speed of the endless belt is different than the peripheral speed of the fixing roller.

According to yet another aspect of the present invention, the one rotatively driven belt support roller is the second belt support roller arranged on the downstream side in the rotational direction of the fixing roller, the second belt support roller is rotatively driven so that the rotational direction thereof is in a direction opposite that of the rotational direction of the fixing roller, and the endless belt is moved in the same rotational direction as the fixing roller in a nip region of the endless belt that is formed by a portion of the outer peripheral surface of the endless belt in pressure contact with a portion of the outer peripheral surface of the fixing roller.

According to yet another aspect of the present invention, the one rotatively driven belt support roller is the first belt support roller arranged on the upstream side in the rotational direction of the fixing roller, the first belt support roller is rotatively driven so that the rotational direction thereof is the same rotational direction of the fixing roller, and the endless belt is moved in a rotational direction opposite that of the fixing roller in a nip region of the endless belt that is formed by a portion of the outer peripheral surface of the endless belt in pressure contact with a portion of the outer peripheral surface of the fixing roller.

According to yet another aspect of the present invention, the heating means is a heater arranged in the interior of the first and second belt support rollers, and the first and second belt support rollers are both in pressure contact with the fixing roller via the endless belt.

According to yet another aspect of the present invention, the heating means is a heater arranged in the interior of the first and second belt support rollers, and the first and second belt support rollers are arranged across a gap from the outer peripheral surface of the fixing roller on the upstream and downstream sides of the fixing roller in the rotational direction.

According to yet another aspect of the present invention, the heating means is arranged in an interior hollow space defined by the endless belt and the first and second belt support rollers.

With the present invention described above, the localized burden with respect to the fixing roller will not increase, the durability of the fixing roller will not be harmed, and the time needed to warm up the fixing roller will be shortened and thus the total warm up time will be shortened.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Preferred embodiments of a fixing device configured in accordance with the present invention will be described in detail below with reference to the attached figures. Note that in each figure, the same or substantially the same components will be identified with the same reference numbers.

First Embodiment

Figure 1:
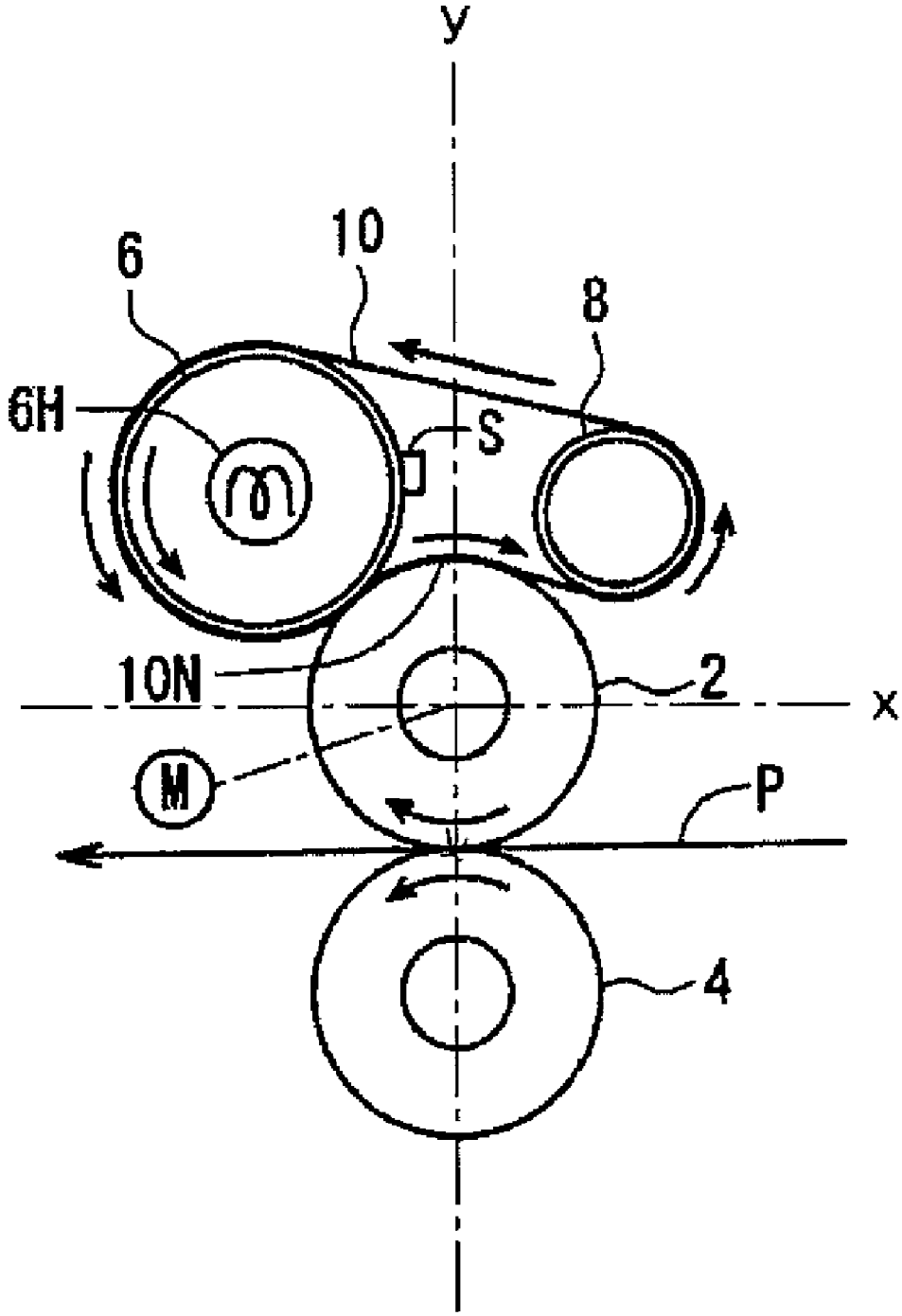
FIG. 1 is a schematic diagram of a fixing device according to a first embodiment of the present invention.

Referring to FIG. 1, an embodiment of the fixing device according to the present invention includes a fixing roller 2, a pressure roller 4 that is in pressure contact with the fixing roller 2 from below, two belt support rollers 6 and 8 that are mutually spaced apart from each other, and an endless belt 10 that is wrapped around both the belt support rollers 6 and 8. A portion of the outer peripheral surface of the endless belt 10 is in pressure contact with a portion of the outer peripheral surface of the fixing roller 2.

The belt support roller 6 is a heat roller, and includes a heating means 6H installed in the interior thereof. A control unit (more specifically a thermistor S) that serves to control the temperature of the belt support roller 6 is arranged in the space defined by the endless belt 10 and the belt support rollers 6 and 8, and is in contact with the outer peripheral surface of the belt roller 6. Other examples of a control unit for controlling the temperature of the belt support roller 6 include a thermostat composed of a switch that turns the heating means 6H on and off. By arranging a control unit for controlling the temperature of the belt support roller 6 inside the space defined by the endless belt 10 and the belt support rollers 6 and 8, the fixing device can be made compact. Paper P is transported in a generally horizontal plane from right to left in FIG. 1.

The fixing device includes a housing (not shown in the figures), the housing including a pair of side walls that are arranged across a gap and extend along the front and rear of the paper P. The fixing roller 2, the pressure roller 4, and the belt support rollers 6 and 8 are rotatively supported between the pair of side walls and mutually parallel. The thermistor S is installed on a support frame (not shown in the figures) that is arranged across the pair of side walls. The belt support roller 6 is in pressure contact with the fixing roller 2 via the endless belt 10. By placing a portion of the outer peripheral surface of the endless belt 10 in pressure contact with a portion of the outer peripheral surface of the fixing roller 2, a nip region 10N of the endless belt 10 will be formed with respect to the fixing roller 2. The belt support roller 6 is arranged on the uppermost upstream position (the left edge in FIG. 1) in the rotational direction of the fixing roller 2 (the clockwise direction in FIG. 1).

If one views the fixing roller 2 from the axial direction (from the front to the rear of the paper surface), and assumes that a virtual horizontal line that passes through the axial center of the fixing roller 2 is the x axis and a virtual vertical line that passes through the axial center of the fixing roller 2 and perpendicular to the x axis is the y axis, the belt support roller 6 is arranged so that it is in pressure contact with the outer peripheral surface of the fixing roller 2 in an intermediate position in the circumferential direction of the second quadrant (in this embodiment, a position in the second quadrant that is somewhat closer to the apex of the outer peripheral surface of the fixing roller 2 than the center of the second quadrant in the circumferential direction). On the other hand, the belt support roller 8 is arranged with respect to the belt support roller 6 on the downstream side of the fixing roller 2 in the rotational direction, and on the upstream side of the paper P in the transport direction (i.e., in the first quadrant). In addition, the belt support roller 8 is arranged across a gap from the outer peripheral surface of the fixing roller 2. The heating means 6H is supported in a stationary state between the pair of side walls in the central region of the belt support roller 6.

The fixing roller 2 is linked to an electric motor M (a drive source) via a power transmission mechanism (not shown in the figures) composed of gears and the like. The belt support roller 6 is arranged such that it is rotatively driven by the fixing roller 2 via the endless belt 10.

The fixing roller 2 and the pressure roller 4 are formed from a core bar made of iron, a silicone sponge that covers the core bar, and a PFA tube that covers the silicone sponge. Each of the belt support rollers 6 and 8 are formed from a hollow tube made of aluminum. The belt support roller 8 has a diameter that is smaller than that of the belt support roller 6. This allows heat loss due to the belt support roller 8 to be reduced. The fixing belt 10 can be formed from a polyimide resin, Ni, or SUS. In this embodiment, the fixing belt 10 is formed from polyimide resin. The heating means 6H is formed from a halogen heater, but may be formed from another heating means such as an excitation coil (IH coil) used for electromagnetic induction heating (the same is true for the other embodiments shown in FIGS. 2 to 5 and 15).

Next, the operation of the fixing device will be described.

When the fixing roller 2 is rotatively driven in the clockwise direction in FIG. 1 by the electric motor M, the pressure roller 4 will be driven in the counterclockwise direction. At the same time, the belt support roller 6 will be driven in the counterclockwise direction in FIG. 1 by the fixing roller 2 via the endless belt 10. As a result, the endless belt 10 will be rotatively driven in the same counterclockwise direction, and the belt support roller 8 will also be rotatively driven in the same counterclockwise direction via the endless belt 10.

Then, the halogen heater that forms the heating means 6H will be turned on, and when heat generation begins, the heat from the heating means 6H will be transmitted from both the belt support roller 6 and the endless belt 10 to the fixing roller 2, and the temperature of the fixing roller 2 will begin to rise. The heat transmitted to the fixing roller 2 will also be transmitted to the pressure roller 4. After the surface temperature of the fixing roller 2 changes from room temperature to a predetermined temperature, paper P, on one surface (the upper surface) of which toner has been transferred, will be transported in a generally horizontal direction from right to left in FIG. 1. When the paper P passes the nip portion of fixing roller 2 and the pressure roller 4, the unfixed toner transferred onto the one side of the paper P will be melted and fixed to the one side of the paper P by the fixing roller 2.

The present embodiment is configured such that a portion of the outer peripheral surface of the endless belt 10 is in pressure contact with a portion of the outer peripheral surface of the fixing roller 2. In other words, because the flexible endless belt 10 is in pressure contact with a portion of the outer peripheral surface of the fixing roller 2 and forms the nip region 10N, the nip width for heating the fixing roller 2 can be greatly increased when compared to that of the prior art. As a result, the localized load with respect to the fixing roller 2 will not increase, the durability of the fixing roller 2 will not be harmed, the warm up time of the fixing roller 2 can be shortened to thus shorten the total warm up time of the fixing device. The same effects can be substantially obtained in the other embodiments described below.

With the aforementioned fixing device, because the belt support roller 6 is in pressure contact with the fixing roller 2 via the endless belt 10, the heat from the halogen heater that forms the heating means 6H is transmitted from both the belt support roller 6 and the endless belt 10 to the fixing roller 2, and the percentage of heat transmitted to the fixing roller 2 will increase and shorten the time needed to warm up the fixing roller 2, the total time needed to warm up the fixing device will be shortened.

In the aforementioned fixing device, because the belt support roller 6 is arranged in the nip region 10N of the endless belt 10 in the uppermost upstream position (the left edge in FIG. 1) in the rotational direction (the clockwise direction in FIG. 1) of the fixing roller 2, the loss of heat transmitted to the endless belt 10 via the belt support roller 6 can be reduced, and the time needed to warm up the fixing roller 2 will be shortened.

In the aforementioned fixing device, because the belt support roller 6 is arranged such that it is rotatively driven by the fixing roller 2 via the endless belt 10, it will no longer be necessary to provide a separate drive means in order to rotatively drive the belt support rollers 6 and 8.

Second Embodiment

Figure 2:
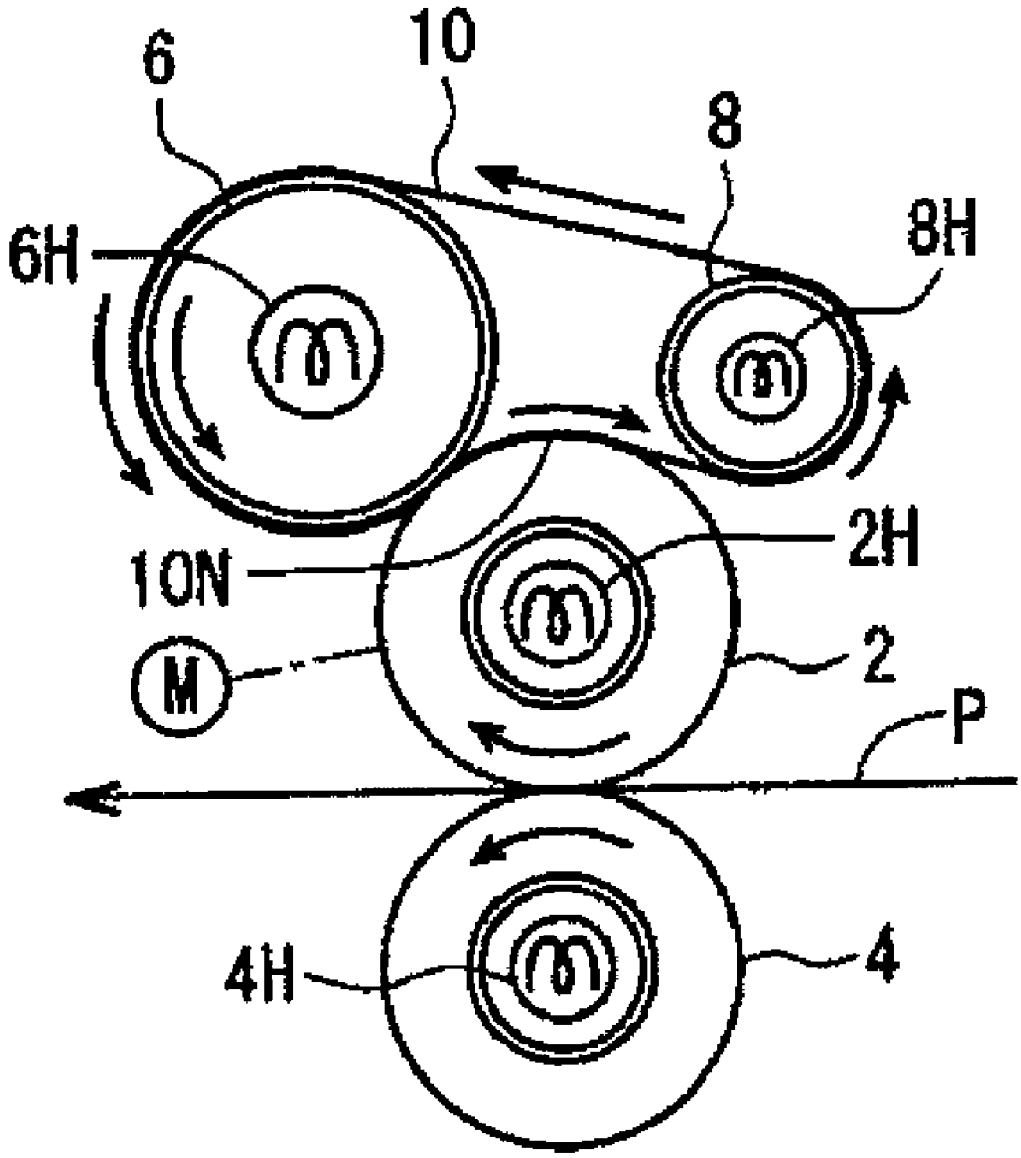
FIG. 2 is a schematic diagram of a fixing device according to a second embodiment of the present invention.

Next, referring to FIG. 2, a fixing device according to second embodiment will be described. The points in which the fixing device shown in FIG. 2 differ from the fixing device shown in FIG. 1 are (1) the belt support roller 8 that interposes the fixing roller 2 between it and the belt support roller 6 and arranged on the downstream side in the rotational direction of the fixing roller 2 is a heat roller in which a heating means 8H is installed therein, (2) the fixing roller 2 has a heating means 2H installed therein, and (3) the pressure roller 4 has a heating means 4H installed therein. The remaining portions of the fixing device of FIG. 2 are the same as those shown in FIG. 1, and thus a detailed description thereof will be omitted.

The heating means 8H, 2H, and 4H are each formed from a halogen heater, and are each supported in a stationary state between the pair of side walls in the housing of the fixing device, in the central regions of the belt support roller 8, the fixing roller 2, and the pressure roller 4. In addition, the fixing roller 2 and the pressure roller 4 include a core bar composed of a hollow tube made of aluminum, iron, or the like, and an elastic body such as silicone rubber that covers the core bar. The surface of the elastic body is either coated with PFA, PTFE, or the like, or is covered with a PFE tube or the like. According to this fixing device, the fixing roller can be heated from room temperature to a predetermined temperature in an even shorter amount of time, and thus the fixing device can be warmed up in an even shorter amount of time.

Durable materials such as Ni, SUS, polyimide resin, or the like have been considered for the materials that form the endless belt 10. However, after the endless belt 10 is heated during fixing operations, the rotation of the fixing roller 2 is stopped, and the endless belt 10 is cooled to a temperature lower than during fixing, the endless belt 10 may deform to a circular arc shape having the radius of the belt support rollers 6 and 8 around which the endless belt 10 is wrapped (i.e., the endless belt 10 may sag). When the endless belt 10 is deformed to a circular arc shape and is wrapped around a belt support roller 8 having a particularly small radius, even if the fixing roller 2 is driven and the rotation of the endless belt 10 is attempted, the deformation produced in the endless belt 10 will resist the rotation, and the endless belt 10 may no longer be able to be rotated.

However, in the second embodiment, because the heating means 8H is installed even in a belt support roller 8 having a small diameter, the belt support roller 8 can be pre-heated to a predetermined temperature before the next fixing operation is performed, and thus problems such as the non-rotatability of the endless belt 10 due to sagging can be prevented. Note that in the fixing device shown in FIG. 2, the heating means 2H and 4H in the fixing roller 2 and the pressure roller 4 can be respectively omitted.

Third Embodiment

Figure 3:
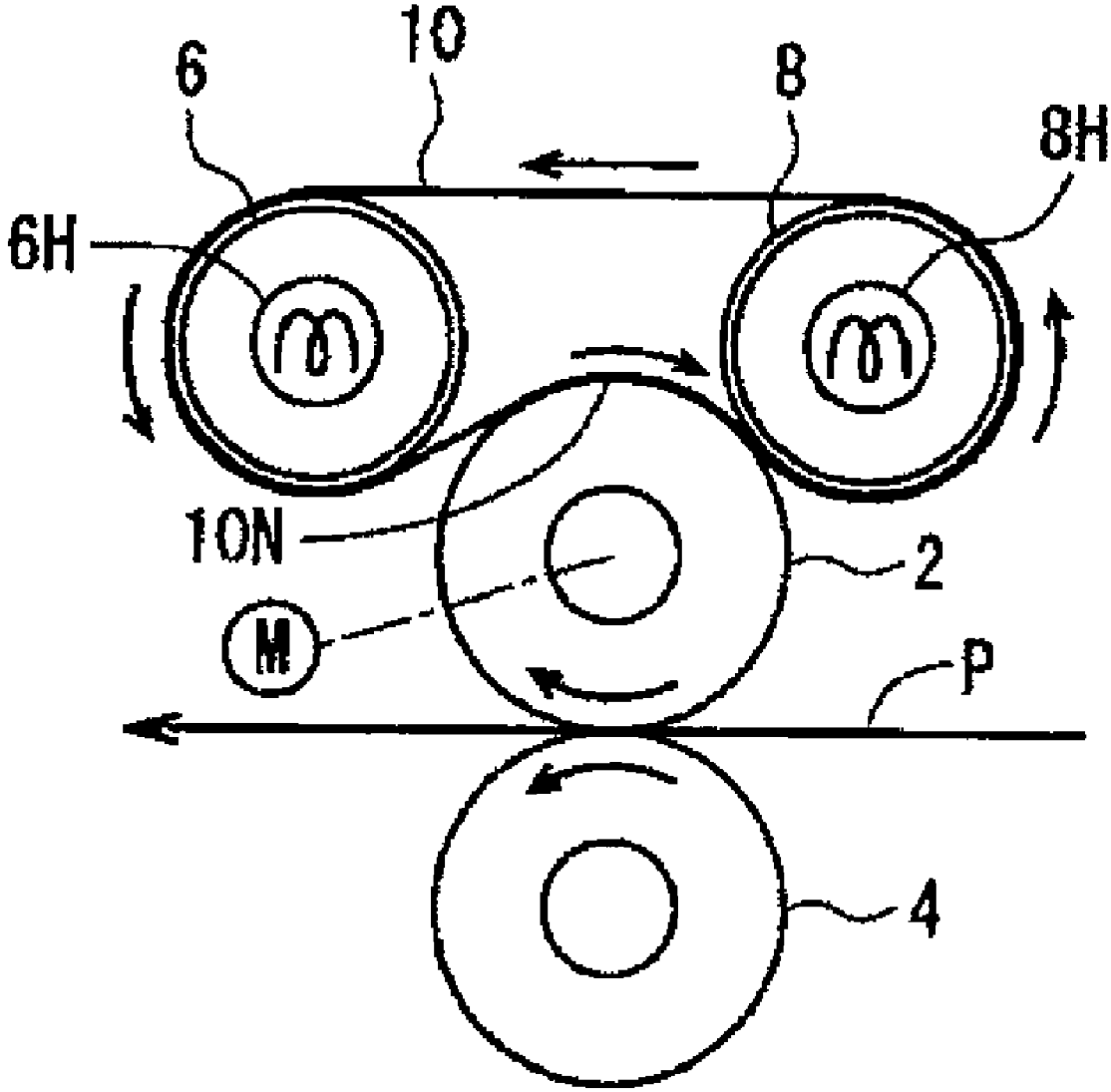
FIG. 3 is a schematic diagram of a fixing device according to a third embodiment of the present invention.

FIG. 3 shows a fixing device according to a third embodiment of the present invention. With the fixing device shown in FIG. 3, the belt support roller 8 is arranged on the downstream side in the rotational direction of the fixing roller 2 with respect to the belt support roller 6, and is a heat roller in which a heating means 8H is installed. In addition, the belt support roller 8 is in pressure contact with the fixing roller 2 in the aforementioned first quadrant via the endless belt 10. Here, by placing a portion of the outer peripheral surface of the endless belt 10 in pressure contact with a portion of the outer periphery of the fixing roller 2, a nip region 10N of the endless belt 10 will be formed with respect to the fixing roller 2, and the belt support roller 8 will be arranged in the nip region 10N in the lowermost downstream position in the rotational direction of the fixing roller 2. In addition, the belt support roller 8 will be driven and rotated by the fixing roller 2 via the endless belt 10. On the other hand, the belt support roller 6 is a heat roller in which a heating means 6H is installed, and is arranged on the upstream side in the rotational direction of the fixing roller 2 with respect to the belt support roller 8. In addition, on the downstream side in the transport direction of the paper P, the belt support roller 6 is arranged across a gap from the outer peripheral surface of the fixing roller 2 (in the aforementioned second quadrant). The other portions of this fixing device are substantially the same as those of the fixing device shown in FIG. 1, and thus a description thereof will be omitted.

In the fixing device shown in FIG. 3, when the fixing roller 2 is rotatively driven by the electric motor M, the belt support roller 8 will be in pressure contact with the fixing roller 2 via the endless belt 10, and thus will be rotatively driven thereby. In addition, in the nip region 10N of the endless belt 10, the endless belt 10 is urged such that it is pulled downward and toward the downstream side in the rotational direction of the fixing roller 2, and placed in pressure contact with the outer peripheral surface of the fixing roller 2. Thus, sufficient adherence with respect to the fixing roller 2 and the endless belt 10 will be maintained, heat transmittance will be effectively performed, and the time needed to heat up the fixing roller 2 will be shortened.

Fourth Embodiment

Figure 4:
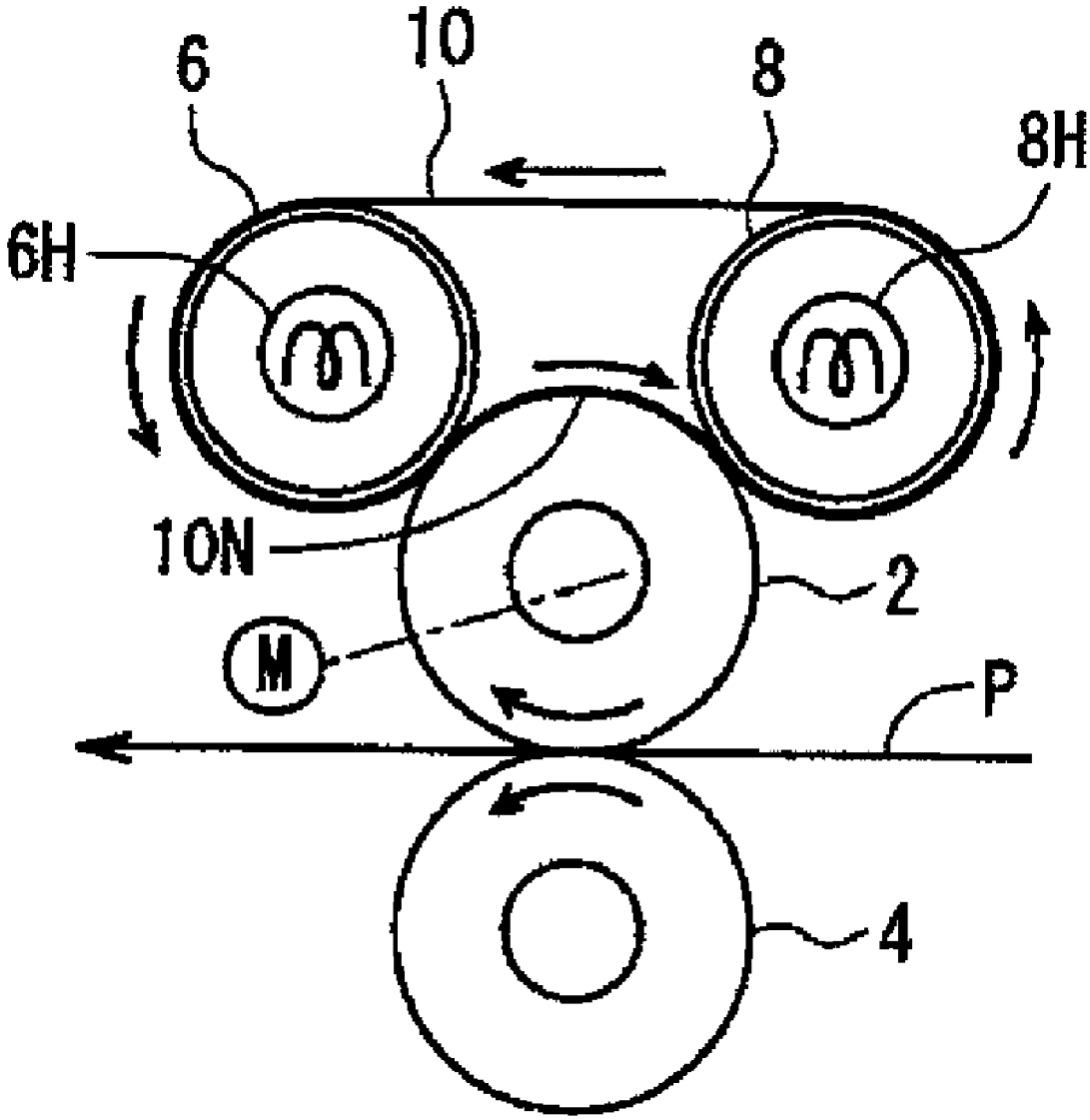
FIG. 4 is a schematic diagram of a fixing device according to a fourth embodiment of the present invention.

FIG. 4 shows a fixing device according to a fourth embodiment of the present invention. The fixing device shown in FIG. 4 is configured such that two belt support rollers 6 and 8 are in pressure contact with the outer peripheral surface of the fixing roller 2 via the endless belt 10, and are rotatively driven by the fixing roller 2 via the endless belt 10. The belt support roller 6 is arranged in the aforementioned second quadrant, and the belt support roller 8 is arranged in the aforementioned first quadrant. The belt support rollers 6 and 8 are both heat rollers in which heating means 6H and 8H formed from a halogen heater or the like are respectively installed. The other portions of this fixing device are substantially the same as those of the fixing device shown in FIG. 1, and thus a description thereof will be omitted.

According to this fixing device, heat transfer with respect to the fixing roller will be effectively performed by both the belt support rollers 6 and 8 and the endless belt 10, and thus the time needed to warm up the fixing roller 2 will be further shortened.

Fifth Embodiment

Figure 5:
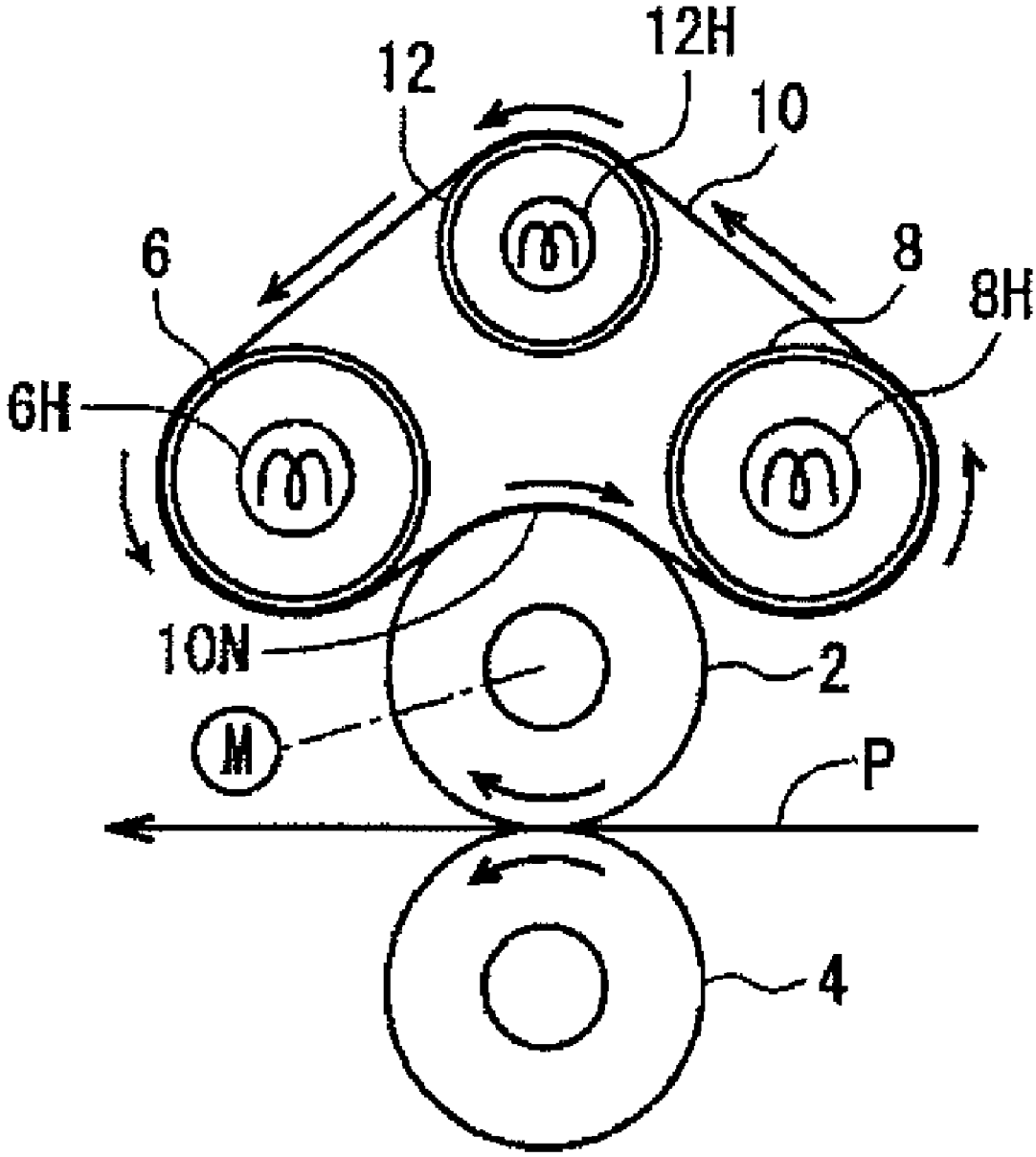
FIG. 5 is a schematic diagram of a fixing device according to a fifth embodiment of the present invention.

FIG. 5 shows a fixing device according to a fifth embodiment of the present invention. The fixing device shown in FIG. 5 includes three belt support rollers 6, 8 and 12 that are mutually spaced apart from each other. The belt support rollers 6 and 8 are arranged across a gap from the outer peripheral surface of the fixing roller 2, and on the upstream and downstream sides in the rotational direction of the fixing roller 2. The belt support roller 12 is arranged in between the belt support rollers 6 and 8, and across a space above the fixing roller 2. The belt support roller 6 is arranged in the aforementioned second quadrant, and the belt support roller 8 is arranged in the aforementioned first quadrant. The belt support roller 12 is arranged approximately in a boundary region between the aforementioned first quadrant and the second quadrant. A portion of the outer peripheral surface of the endless belt 10 (the nip region 10N) that is in pressure contact with a portion of the outer peripheral surface of the fixing roller 2 is arranged in between the two belt support rollers 6 and 8. The belt support rollers 6, 8 and 12 are heat rollers in which heating means 6H, 8H and 12H formed from a halogen heater or the like are respectively installed. In addition, the belt support rollers 6, 8 and 12 will be driven by the fixing roller 2 via the endless belt 10. The other portions of this fixing device are substantially the same as those of the fixing device shown in FIG. 1, and thus a description thereof will be omitted.

According to this fixing device, because only the endless belt 10 is in pressure contact with the fixing roller 2, the localized burden with respect to the fixing roller 2 will be lightened to the greatest degree, and thus the durability of the fixing roller 2 will be maintained more sufficiently.

Sixth Embodiment

Figure 6:
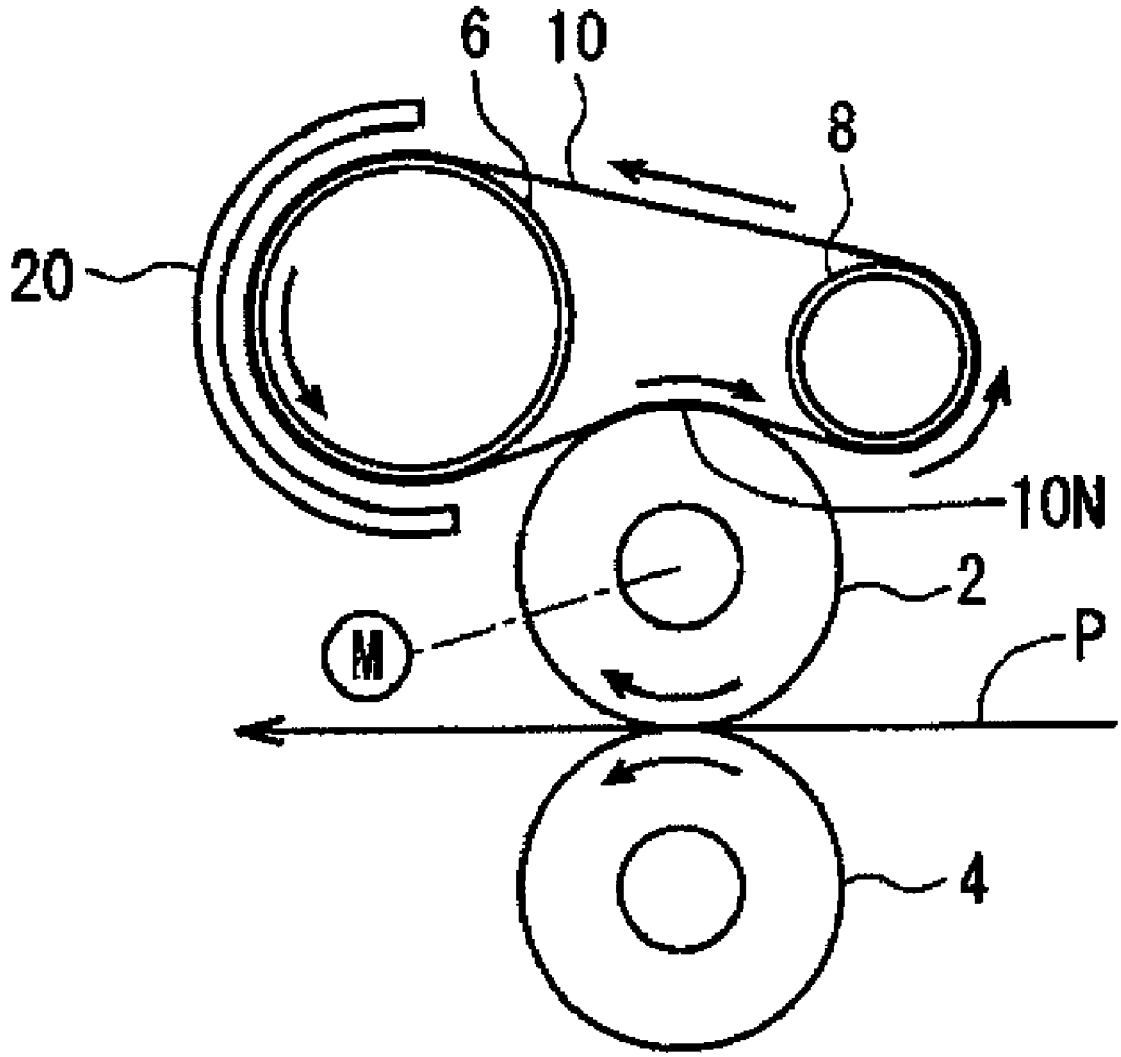
FIG. 6 is a schematic diagram of a fixing device according to a sixth embodiment of the present invention.

FIG. 6 shows a fixing device according to a sixth embodiment of the present invention. The fixing device shown in FIG. 6 includes two belt support rollers 6 and 8 that are mutually spaced apart from each other. The belt support rollers 6 and 8 are arranged across a gap from the fixing roller 2, upstream and downstream in the rotational direction of the fixing roller 2. The belt support roller 6 is arranged in the aforementioned second quadrant, and the belt support roller 8 is arranged in the aforementioned first quadrant. A portion of the outer peripheral surface of the endless belt 10 (the nip region 10N) that is in pressure contact with a portion of the outer peripheral surface of the fixing roller 2 is arranged in between the two belt support rollers 6 and 8. In this embodiment, heating means are installed in both belt support rollers 6 and 8. The belt support rollers 6 and 8 are driven by the fixing roller 2 via the endless belt 10.

An excitation coil 20 for electromagnetic induction heating, i.e., an IH coil 20, is arranged across a gap from at least a portion of the outer peripheral surface of the belt support roller 6 so as to cover the same. In this embodiment, the belt support roller 6 is formed from a hollow tube made of a metal such as aluminum or the like, and the endless belt 10 is formed from a metal such as Ni, SUS, or the like. The IH coil 20 is composed of a coil that is helically wrapped in the axial direction of the belt support roller 6.

Here, when a high frequency electric current from a high frequency electrical source or the like (not shown in the figures) flows to the IH coil 20, induced surplus current will be generated in the belt support roller 6 by the high frequency magnetic field that is generated, and the belt support roller 6 and the endless belt 10 will be heated by means of Joule heat. The heat of the belt support roller 6 and the endless belt 10 heated by the IH coil 20 is transmitted to the fixing roller 2 via the endless belt 10. The other portions of this fixing device are substantially the same as those of the fixing device shown in FIG. 1, and thus a description thereof will be omitted.

According to this fixing device, the localized load on the fixing roller 2 will not increase, the durability of the fixing roller 2 will not be harmed, and the fixing roller 2 can be efficiently heated via the belt support roller 6 and the endless belt 10 by means of the electromagnetic induction heating method. Thus, the time needed to warm up the fixing roller 2 can be shortened, which will shorten the total time needed to warm up the fixing device. In this embodiment the IH coil 20 can also be arranged on the belt support roller 8 side, and an embodiment in which both the belt support roller 6 and the belt support roller 8 are heated by electromagnetic induction is also possible. It is also possible to apply this type of electromagnetic induction heating to the embodiments of the fixing device shown in FIGS. 1 to 5. In this situation, a variety of examples can be considered, such as an embodiment in which the heating means 6H, 8H and 12H are not respectively installed in the belt support rollers 6, 8 and 12, an embodiment in which the heating means 2H and 4H are not respectively installed in the fixing roller 2 and the pressure roller 4, an embodiment in which none of the heating means 2H, 4H, 6H, 8H and 12H are used, an embodiment in which a heating means is installed in any of the belt support rollers 6, 8, 12, and the like. In all cases, by effectively combining an IH coil 20, another heating means such as a halogen heater or the like, and the belt support rollers 6, 8 and 12, the time needed to warm up the fixing roller 2 can be further shortened, and the time needed to warm up the fixing device can be further shortened.

In the embodiment shown in FIG. 6, the belt support roller 6 is formed from a hollow tube made of metal, and the endless belt 10 is formed from metal. However, in order to apply the electromagnetic induction heating system described above to the embodiments of the fixing device shown in FIGS. 1 to 5, the belt support roller 6 will be made of metal and the endless belt 10 will be made of a synthetic resin such as a polyimide resin or the like, or the belt support roller 6 will be made of a synthetic resin and the endless belt 10 will be made of metal. In addition, in the event that the endless belt 10 or the belt support roller 6 is made of a synthetic resin, a conductive metal layer will be arranged on the outer peripheral surface thereof that faces the IH coil 20.

Seventh Embodiment

In the aforementioned embodiments, the belt support roller 6 is configured so as to be rotatively driven by the fixing roller 2 via the endless belt 10. However, the belt support roller 6 can instead be driven by the fixing roller 2 by means of a power transmission mechanism such as gears and the like. In addition, the belt support roller 6 can also be independent from the fixing roller 2, and rotatively driven.

Figure 7:
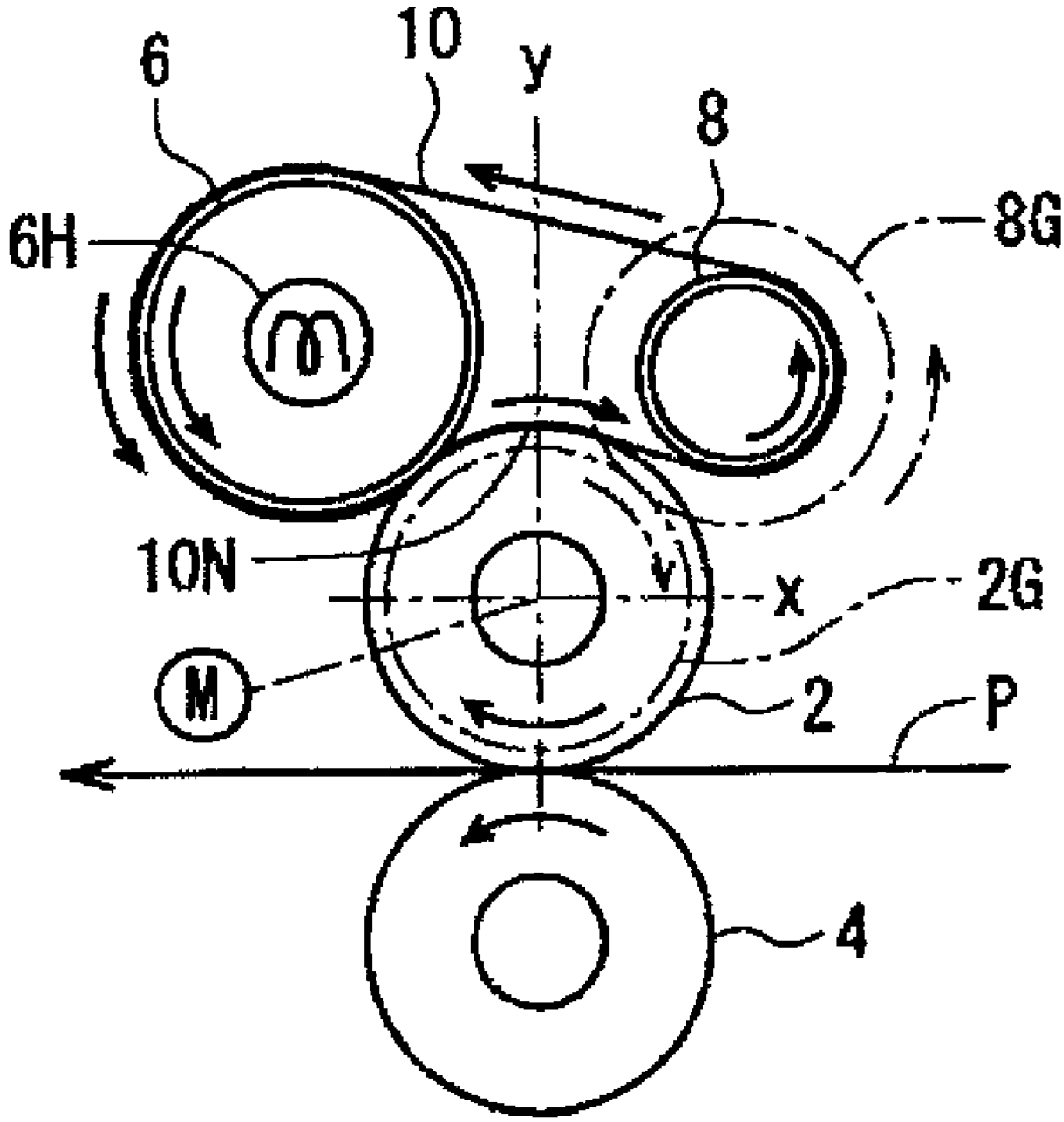
FIG. 7 is a schematic diagram of a fixing device according to a seventh embodiment of the present invention.

A seventh embodiment having this type of configuration is shown in FIG. 7. The configuration of the seventh embodiment is the same as that of the first embodiment shown in FIG. 1 with the exception of the drive mechanism of the endless belt and the belt support rollers, and thus only the portions of the seventh embodiment that are different than the first embodiment will be described.

The fixing roller 2 is rotatively driven by engaging with an electric motor M (a drive source). The electric motor M is arranged inside the device unit of an image forming device (not shown in the figures). A drive gear 2G is arranged on an end of the fixing roller 2 in the axial direction (the rear end in the axial direction, i.e., to the rear of the paper P in FIG. 7) so that the drive gear 2G can integrally rotate with the fixing roller 2. The drive gear 2G is linked to the electric motor M via a power transmission mechanism (not shown in the figures) such as gears, a clutch, and the like. Thus the fixing roller 2 will be rotatively driven by means of the electric motor M, via the power transmission mechanism such as gears, a clutch, and the like and the drive gear 2G.

The belt support roller 8 is rotatively driven by the fixing roller 2 by directly or indirectly linking it to the fixing roller 2. More specifically, a driven gear 8G is arranged on an end of the belt support roller 8 in the axial direction so that the driven gear 8G can integrally rotate with the belt support roller 8, and the driven gear 8G is meshed with the drive gear 2G of the fixing roller 2.

In this embodiment, when the fixing roller 2 is rotatively driven in the clockwise direction in FIG. 7 by the electric motor M, the pressure roller 4 will be rotatively driven in the counterclockwise direction. At the same time, the belt support roller 8 will be rotatively driven in a direction opposite that of the fixing roller 2 (in the counterclockwise direction in FIG. 7) via the drive gear 2G of the fixing roller 2 and the driven gear 8G of the belt support roller 8 meshed with the drive gear 2G. As a result, the endless belt 10 will be rotatively driven in the same counterclockwise direction as the belt support roller 8, and the belt support roller 6 will be rotatively driven in the same counterclockwise direction via the endless belt 10.

In the aforementioned fixing device, the belt support roller 8 arranged on the downstream side of the fixing roller 2 in the rotational direction is a driven belt support roller, and this belt support roller 8 is rotatively driven so that the rotational direction of the belt support roller 8 (the counterclockwise direction in FIG. 7) will be a direction opposite that of the rotational direction of the fixing roller 2 (the clockwise direction in FIG. 7). Then, the endless belt 10 will be configured so as to move in the same rotational direction as the fixing roller 2, in the nip region 10N of the endless belt 10 with respect to the fixing roller 2. Due to this configuration, when the belt support roller 8 is rotatively driven, the endless belt 10 will be urged in pressure contact with the outer peripheral surface of the fixing roller 2 in the nip region 10N, and thus sufficient adherence with respect to the fixing roller 2 and the endless belt 10 will be maintained, heat transfer will be effectively performed, and the time needed to heat up the fixing roller 2 will be shortened.

In the aforementioned fixing device, because the fixing roller 2 is rotatively driven by linking the fixing roller 2 to the electric motor M, and the belt support roller 8 is directly linked to the fixing roller 2 via gears and rotatively driven, the outer peripheral surface of the endless belt 10 in the nip region 10N can be reliably prevented from slipping with respect to the outer peripheral surface of the fixing roller 2, and thus the drive of the endless belt 10 can be stabilized. As a result, heat from the endless belt 10 can be stably supplied to the fixing roller 2, and the time needed to warm up the fixing roller 2 can be shortened. In addition, because the outer peripheral surface of the fixing roller 2 will not degrade, deform, be damaged, or the like, and the durability of the fixing roller 2 will not be harmed, problems such as the generation of wrinkles in the paper that passes through the nip portion of the fixing roller 2 and the pressure roller 4 can be prevented, even when the fixing roller 2 is used for a long period of time.

In the aforementioned fixing device, the belt support roller 8 is rotatively driven so that the peripheral speed of the endless belt 10 is substantially the same as that of the fixing roller 2. However, the fixing device can be easily configured such that the belt support roller 8 is rotatively driven so as to make the peripheral speed of the endless belt 10 different from that of the fixing roller 2. More specifically, by suitably adjusting the gear ratio of the drive gear 2G of the fixing roller 2 and the driven gear 8G of the belt support roller 8, the peripheral speed of the endless belt 10 can be easily made the same as the peripheral speed of the fixing roller 2, faster than the peripheral speed of the fixing roller 2, or slower than the peripheral speed of the fixing roller 2. By making the peripheral speed of the endless belt 10 different than that of the fixing roller 2, the amount of heat supplied from the belt support roller 8 to the fixing roller 2 can be suitably modified compared to when the speeds thereof are equal.

In this embodiment, the belt support roller 8 is directly engaged with and driven by the fixing roller 2 via gears, however the belt support roller 6 arranged on the upstream side can also be configured so as to be directly linked to and driven by the fixing roller 2 via gears. In other words, the fixing device can be easily configured by, for example, integrally arranging a driven gear on the belt support roller 6, and engaging the driven gear with the drive gear 2G.

Eighth Embodiment

Figure 8:
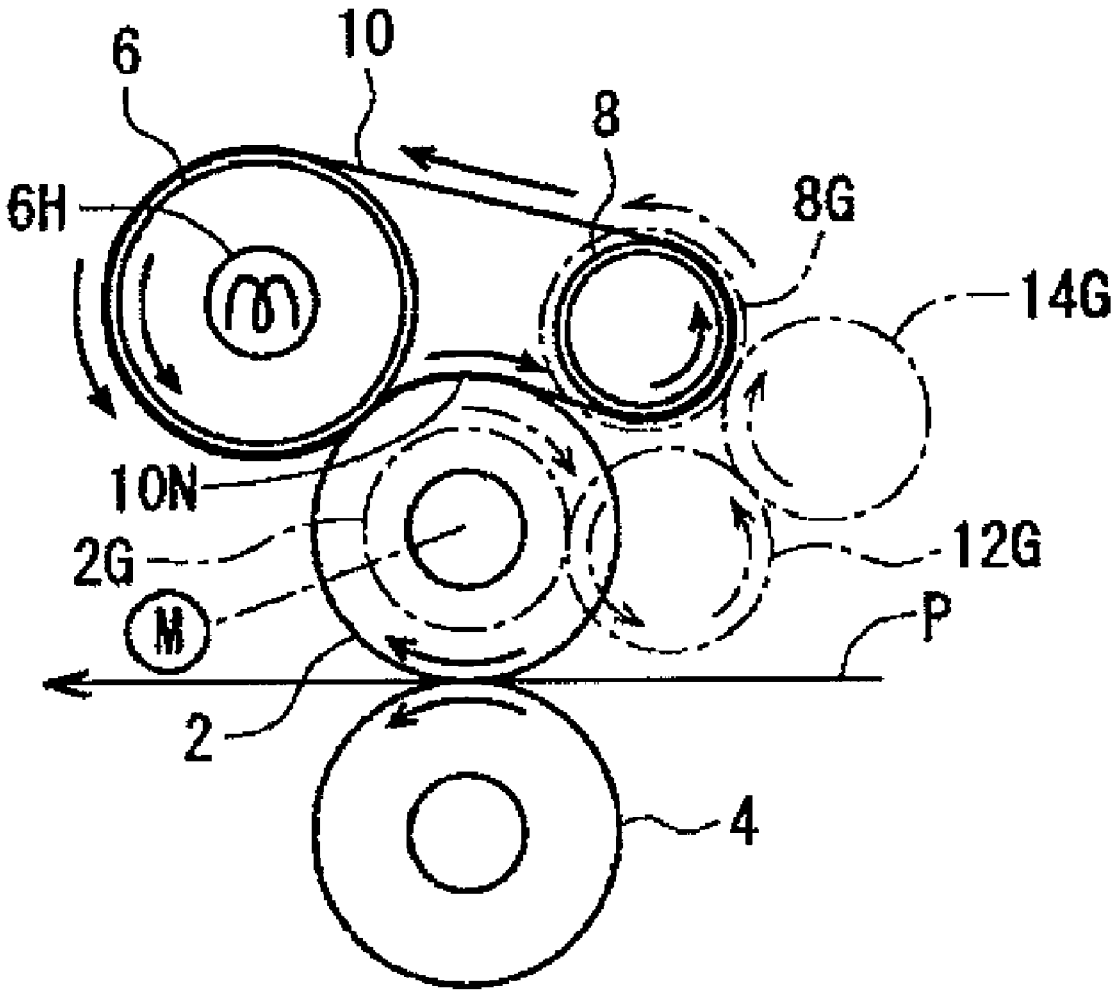
FIG. 8 is a schematic diagram of a fixing device according to an eighth embodiment of the present invention.

An eighth embodiment of the present invention is shown in FIG. 8. The point in which this embodiment differs from the fixing device shown in FIG. 7 is that this embodiment is configured such that the belt support roller 8 is rotatively driven by the fixing roller 2 by means of an indirect linkage between the belt support roller 8 and the fixing roller 2. More specifically, the driven gear 8G of the belt support roller 8 is meshed to the drive gear 2G of the fixing roller 2 via intermediate gears 12G and 14G. The other portions of this fixing device are substantially the same as those of the fixing device shown in FIG. 7, and thus a description thereof will be omitted.

This type of drive system may be useful depending upon the relative relationship of the peripheral space, the gear ratio setting, and the like. Because the fixing device shown in FIG. 8 has substantially the same basic configuration as the fixing device shown in FIG. 7, the fixing device shown in FIG. 8 can, with regard to its basic configuration, achieve substantially the same effects as the fixing device shown in FIG. 7.

Ninth Embodiment

Figure 9:
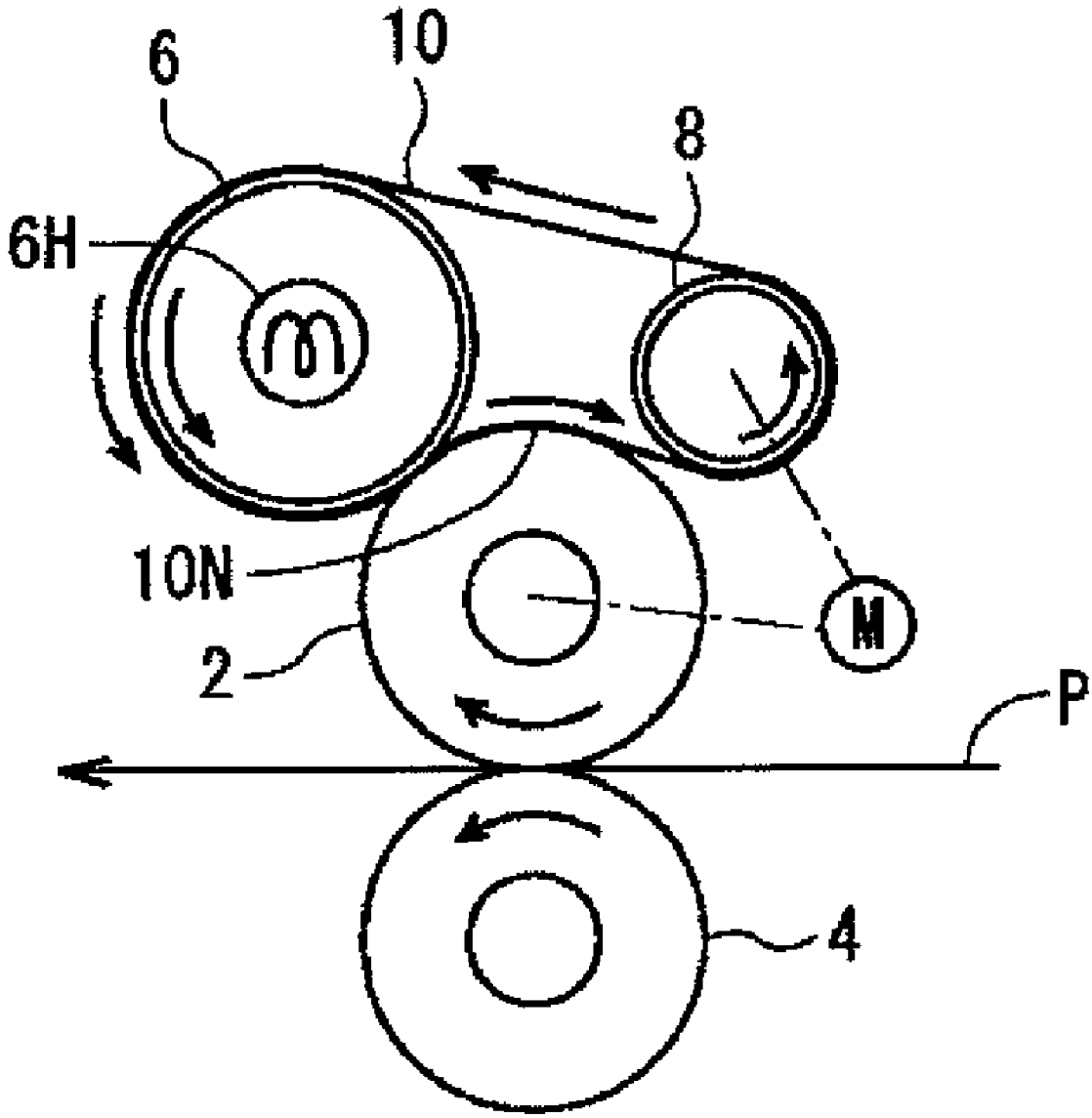
FIG. 9 is a schematic diagram of a fixing device according to a ninth embodiment of the present invention.

A ninth embodiment of the present invention is shown in FIG. 9. The fixing device shown in FIG. 9 is configured such that the belt support roller 8 is linked to the electric motor M of the fixing motor 2 and rotatively driven. More specifically, a driven gear (not shown in the figures) is arranged on the fixing roller 2, and this driven gear is linked to the electric motor M via a power transmission mechanism such as gears or the like (not shown in the figures). On the other hand, a driven gear (not shown in the figures) is integrally arranged on the belt support roller 8, and this driven gear is linked to the electric motor M via a power transmission mechanism not shown in the figures (a power transmission mechanism that is shared with that of the fixing roller 2 or another power transmission mechanism) such as gears, a clutch, and the like. The other portions of this fixing device are substantially the same as those of the fixing device shown in FIG. 7, and thus a description thereof will be omitted.

Here, when the electric motor M is rotatively driven, the fixing roller 2 and the belt support roller 8 will be rotatively driven by a partially shared drive system or by drive systems that are nearly mutually independent. As a result, because control that includes turning the rotational drive of the belt support roller 8 on and off can be performed independently from the fixing roller 2, the amount of heat supplied from the endless belt 10 to the fixing roller 2 can be suitably controlled. Because the fixing device shown in FIG. 9 has substantially the same basic configuration as the fixing device shown in FIG. 7, the fixing device shown in FIG. 8 can, with regard to its basic configuration, achieve substantially the same effects as the fixing device shown in FIG. 7.

Tenth Embodiment

Figure 10:
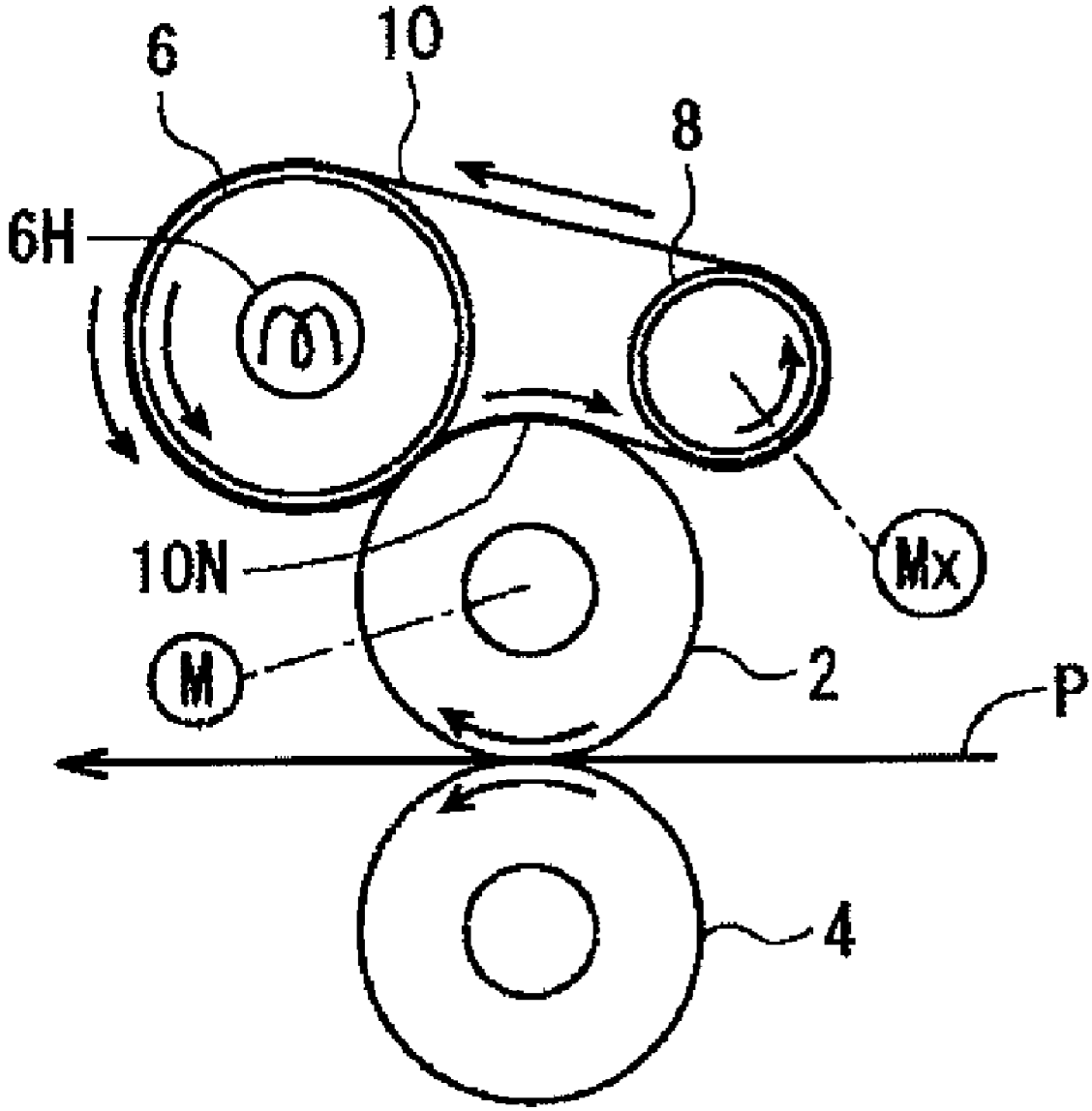
FIG. 10 is a schematic diagram of a fixing device according to a tenth embodiment of the present invention.

A tenth embodiment of the present invention is shown in FIG. 10. In the fixing device shown in FIG. 10, by linking the electric motor M linked to the fixing roller 2 to an electric motor Mx (another power source), the belt support roller 8 will be rotatively driven by the electric motor Mx. More specifically, a driven gear (not shown in the figures) is arranged on the fixing roller 2, and this driven gear is linked to the electric motor M via a power transmission mechanism such as gears, a clutch, or the like (not shown in the figures). On the other hand, a driven gear (not shown in the figures) is arranged on the belt support roller 8, and this driven gear is linked to the electric motor Mx via a power transmission mechanism such as gears, a clutch, or the like (not shown in the figures). The other portions of this fixing device are substantially the same as those of the fixing device shown in FIG. 7, and thus a description thereof will be omitted.

Here, when the electric motor M is rotatively driven, only the fixing roller 2 will be rotatively driven, independent of the belt support roller 8. On the other hand, when the electric motor Mx is rotatively driven, only the belt support roller 8 will be rotatively driven, independent of the fixing roller 2. As a result, control that includes turning the rotational drive of the belt support roller 8 on and off and peripheral speed can be performed totally independently from the fixing roller 2, and the amount of heat supplied from the endless belt 10 to the fixing roller 2 can be more precisely controlled. For example, heat supply control can be easily performed such that when the rotation of the fixing roller 2 is stopped, the rotation of the belt support roller 8 will continue, and the endless belt 10 will move relative to the fixing roller 2 to freely supply heat thereto. In the alternative, the electric motor Mx can be a servo motor, and peripheral speed control can be easily performed such that the peripheral speed of the belt support roller 8, and thus the peripheral speed of the endless belt 10, can be freely changed. In addition, by making the electric motor Mx a servo motor capable of rotating forward and backward, the rotational direction and peripheral speed of the belt support roller 8, and thus the rotational direction and peripheral speed of the endless belt 10, can be easily controlled.

Because the fixing device shown in FIG. 10 has substantially the same basic configuration as the fixing device shown in FIG. 7, the fixing device shown in FIG. 8 can, with regard to its basic configuration, achieve substantially the same effects as the fixing device shown in FIG. 7.

Eleventh Embodiment

Figure 11:
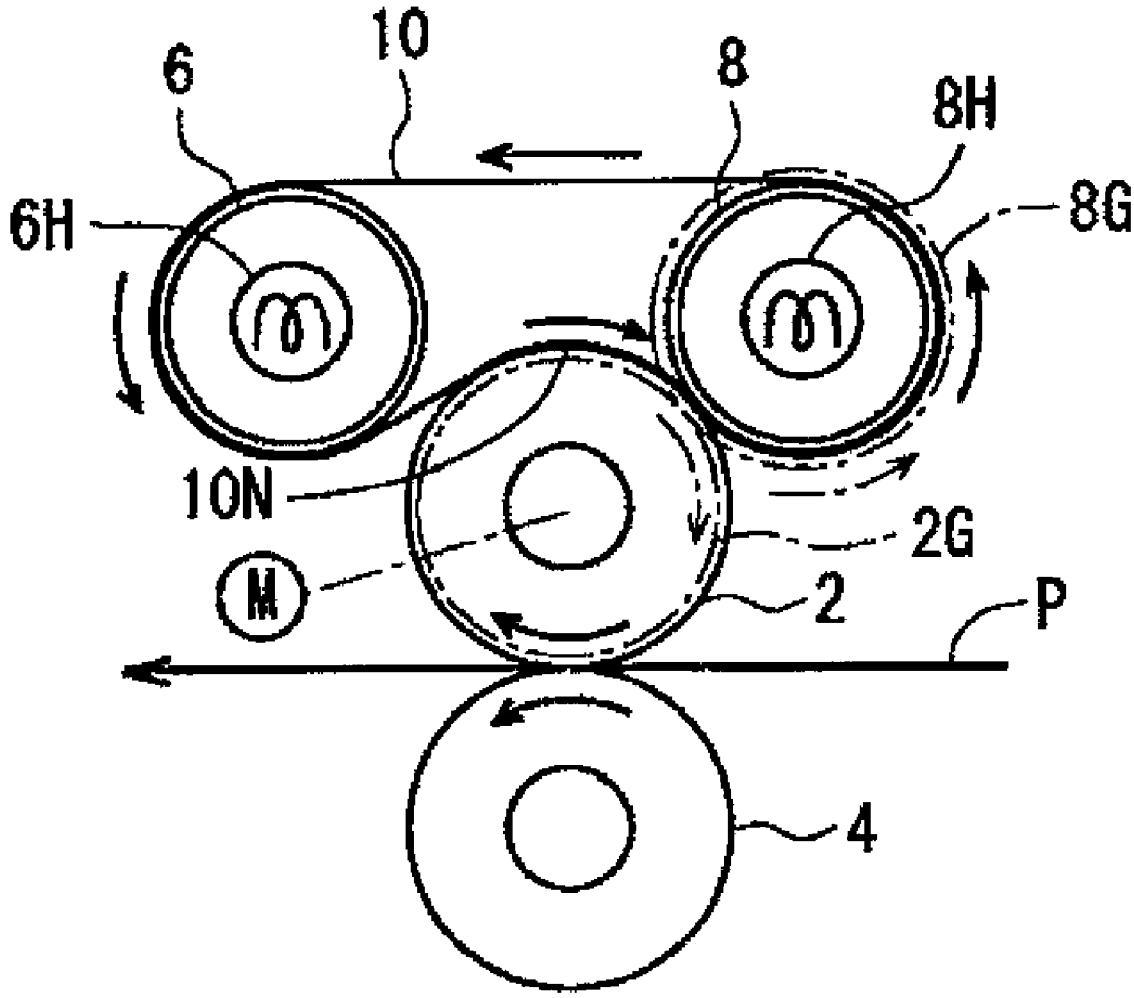
FIG. 11 is a schematic diagram of a fixing device according to an eleventh embodiment of the present invention.

An eleventh embodiment of the present invention is shown in FIG. 11. The fixing device shown in FIG. 11 has the same configuration as that of the third embodiment shown in FIG. 3, except for the drive mechanism of the endless belt and the belt support roller. The portions thereof that are different than the third embodiment have the same configuration as those shown in the seventh embodiment. In other words, a drive gear 2G is arranged on an end of the fixing roller 2 in the axial direction so that the drive gear 2G can integrally rotate with the fixing roller 2. The drive gear 2G is linked to the electric motor M via a power transmission mechanism (not shown in the figures) such as gears, a clutch, and the like. Thus the fixing roller 2 will be rotatively driven by means of the electric motor M, via the power transmission mechanism such as gears, a clutch, and the like and the drive gear 2G. On the other hand, a driven gear 80 is arranged on an end of the belt support roller 8 in the axial direction so that the driven gear 8G can integrally rotate with the belt support roller 8, and the driven gear 8G is meshed with the drive gear 2G of the fixing roller 2.

Here, like above, because the endless belt 10 is urged to be in pressure contact with the outer peripheral surface of the fixing roller 2, sufficient adherence with respect to the fixing roller 2 and the endless belt 10 will be maintained, heat transmittance will be effectively performed, and the time needed to heat up the fixing roller 2 will be shortened. In addition, because the belt support rollers 6 and 8 are formed from heat rollers, this fixing device can shorten the time needed to warm up the fixing roller 2 even more than the fixing device shown in FIG. 7.

Twelfth Embodiment

Figure 12:
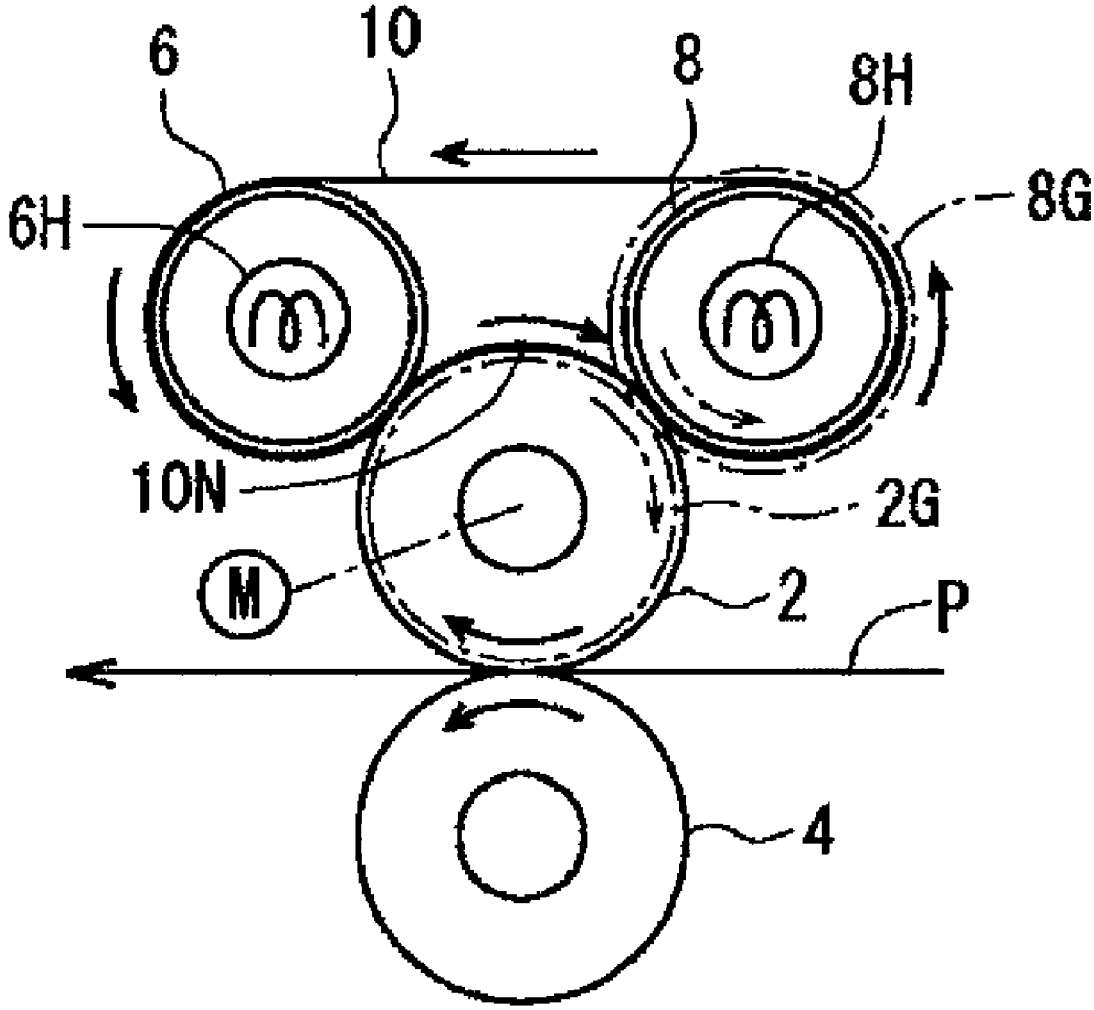
FIG. 12 is a schematic diagram of a fixing device according to a twelfth embodiment of the present invention.

A twelfth embodiment of the present invention is shown in FIG. 12. The fixing device shown in FIG. 12 has the same configuration as that of the fourth embodiment shown in FIG. 4, except for the drive mechanism of the endless belt and the belt support roller. The portions thereof that are different than the fourth embodiment have the same configuration as those shown in the seventh embodiment. In other words, the drive gear 2G is arranged on an end of the fixing roller 2 in the axial direction so as to integrally rotate with the fixing roller 2, and the driven gear 8G is arranged on an end of the belt support roller 8 in the axial direction so as to integrally rotate with the belt support roller 8. The driven gear 8G is meshed with the drive gear 2G of the fixing roller 2.

Here, like above, because heat transfer is effectively performed with respect to the fixing roller 2 by means of both the belt support rollers 6 and 8 and the endless belt 10, the time needed to warm up the fixing roller 2 can be shortened. In addition, sufficient adherence with respect to the fixing roller 2 and the endless belt 10 will be maintained, heat transmittance will be effectively performed, and the time needed to heat up the fixing roller 2 will be further shortened.

Thirteenth Embodiment

Figure 13:
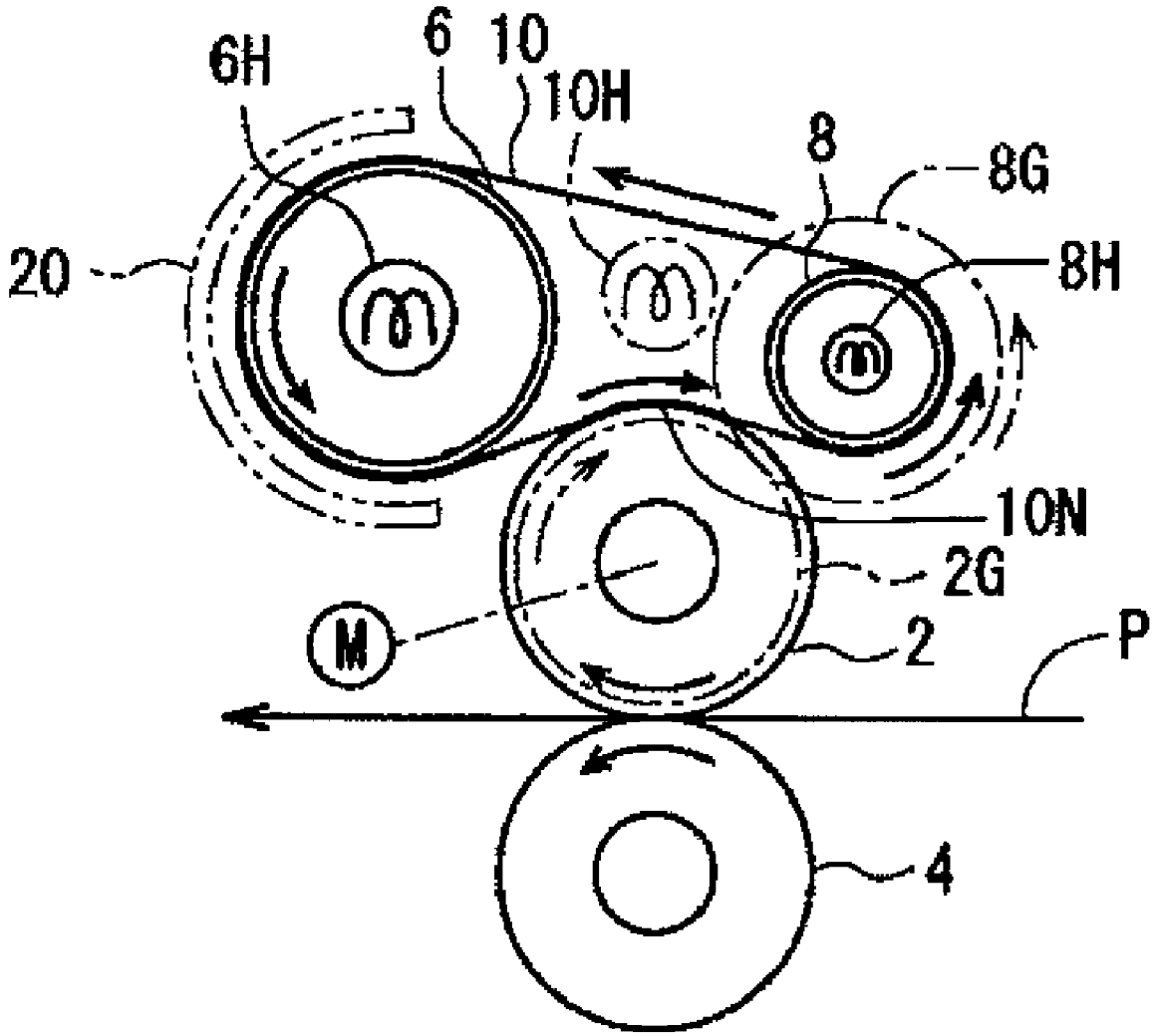
FIG. 13 is a schematic diagram of a fixing device according to a thirteenth embodiment of the present invention.

FIG. 13 shows a thirteenth embodiment of the present invention. The fixing device shown in FIG. 13 includes two belt support rollers 6 and 8 that are mutually spaced apart from each other. The belt support rollers 6 and 8 are arranged across a gap from the fixing roller 2, upstream and downstream in the rotational direction of the fixing roller 2. The belt support rollers 6 and 8 are both heat rollers in which heating means 6H and 8H formed from a halogen heater or the like are respectively installed. The belt support roller 6 is arranged in the aforementioned second quadrant, and the belt support roller 8 is arranged in the aforementioned first quadrant. A portion of the outer peripheral surface of the endless belt 10 (the nip region 10N) is in pressure contact with a portion of the outer peripheral surface of the fixing roller 2, and is arranged in between the two belt support rollers 6 and 8. The other portions of this fixing device are substantially the same as those of the fixing device shown in FIG. 7, and thus a description thereof will be omitted.

According to this fixing device, neither of the belt support rollers 6 and 8 are in pressure contact with the fixing roller 2, and thus a localized load will not increase on the fixing roller 2, the durability of the fixing roller 2 will not be harmed, and the fixing roller 2 can be efficiently heated via the belt support rollers 6 and 8 and the endless belt 10, even more effectively than the previous embodiments. As a result, the time needed to warm up the fixing roller 2 will be shortened, and thus the total time needed to warm up the fixing device will be shortened.

The heating method for the endless belt 10 shown in FIG. 13, in which the belt support rollers 6 and 8 are heat rollers, may be substituted with one in which an excitation coil 20 for electromagnetic induction heating (shown with a dotted and dashed line in FIG. 13), i.e., an IH coil 20, is arranged across a gap from at least a portion of the outer peripheral surface of the belt support roller 6.

In this embodiment, the shape and the materials of the belt support roller 6 and the endless belt 10 are the same as the sixth embodiment shown in FIG. 6, and the configuration and effect of the IH coil 20 is the same as in the sixth embodiment.

In addition, in the embodiment shown in FIG. 13, it is also possible to replace the aforementioned heating methods with one in which a heating means 10H (shown with a dotted and dashed line in FIG. 13) is arranged in an inner hollow space that is defined by the endless belt 10 and the belt support rollers 6 and 8. According to this embodiment, the radiant heat of the heating means 10H can be directly transmitted from the inner space to the inner surface of the endless belt 10 and the outer peripheral surfaces of the belt support rollers 6 and 8. The heat directly transmitted from the heating means 10H to the belt support rollers 6 and 8 will then be transmitted to the endless belt 10. Thus, the heat directly and indirectly transmitted to the endless belt 10 can be transmitted directly to the fixing roller 2 by the endless belt 10. In other words, according to this embodiment, because the heat directly transmitted to the endless belt 10 by the radiant heat of the heating means 10H can be directly transmitted to the fixing roller 2, the time needed to warm up the fixing roller 2 will be shorter than that of the prior art, and thus the total time needed to warm up the fixing device will be shortened. In FIG. 13, the heating means 10H is a single halogen heater arranged in the central portion of the aforementioned hollow space. However, in the event that there are a plurality of halogen heaters, they may be arranged in positions in which the radiant heat from each can be transmitted to the endless belt 10 and the fixing roller 2 more efficiently. In addition, although the heating means 10H described above is a halogen heater, it may instead be an IH coil. The aforementioned IH coil 20, the heating means 10H, and the like, are heating means that directly heat the endless belt 10.

Note that if an electromagnetic induction heating method that uses an IH coil 20 is applied to the embodiment shown in FIG. 13, the belt support roller 6 will be formed from a hollow tube made of metal, and the endless belt 10 will be made of metal. However, in order to apply the aforementioned type of electromagnetic induction heating method to other embodiments, the belt support roller 6 will be made of metal, and the endless belt 10 will be made of a synthetic resin such as a polyimide resin or the like, or the belt support roller 6 will be made of a synthetic resin and the endless belt 10 will be made of metal. In addition, in the event that the endless belt 10 or the belt support roller 6 is made of a synthetic resin, a conductive metal layer will be arranged on the outer peripheral surface thereof that faces the IH coil 20. In addition, in the event that the endless belt 10 or the belt support roller 6 is made of a synthetic resin, a conductive metal layer will be arranged on the outer peripheral surface thereof that faces the IH coil 20.

Fourteenth Embodiment

Figure 14:
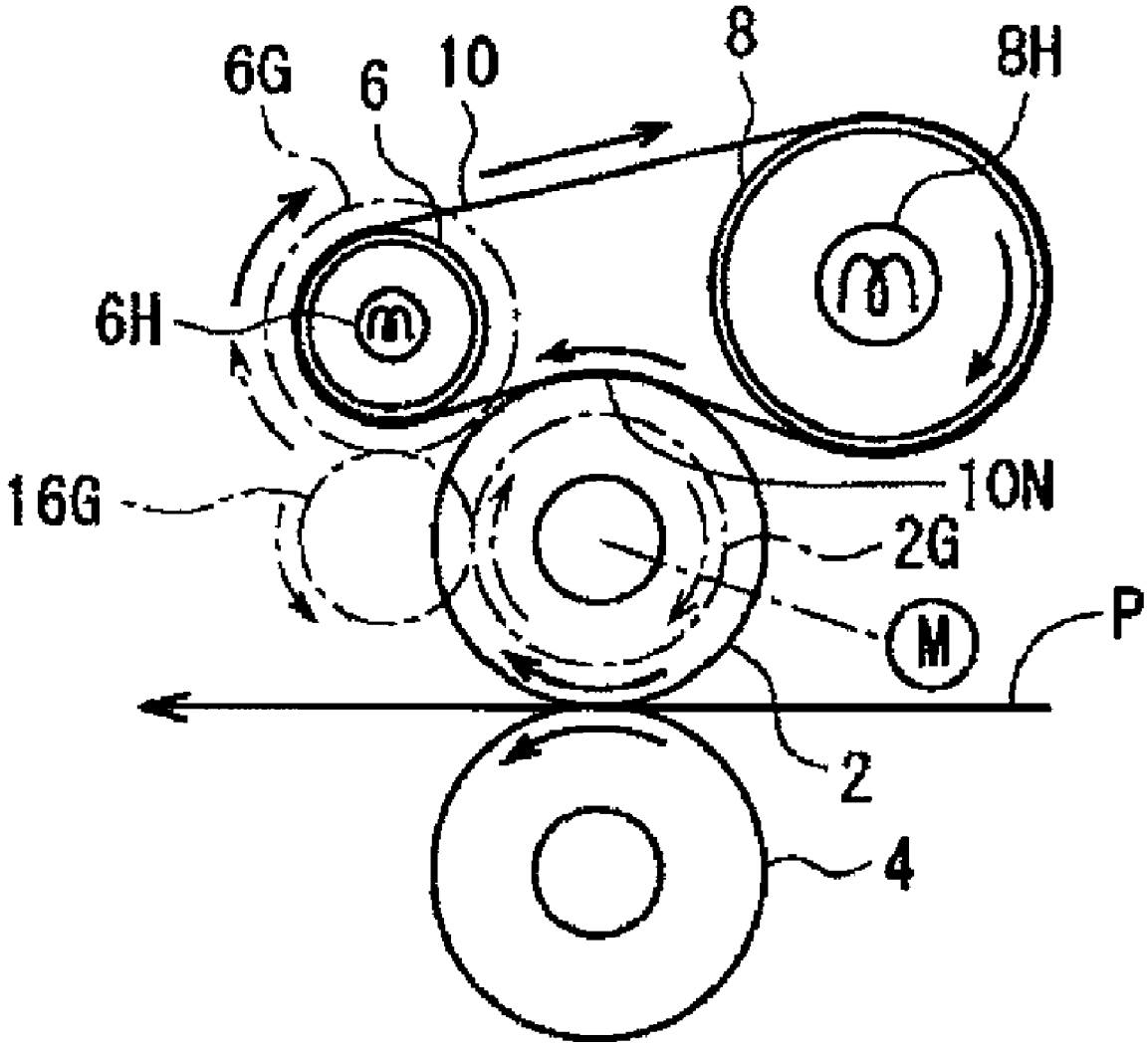
FIG. 14 is a schematic diagram of a fixing device according to a fourteenth embodiment of the present invention.

A fourteenth embodiment of the present invention is shown in FIG. 14. In the fixing device shown in FIG. 14, a belt support roller 6 arranged on the upstream side in the rotational direction of the fixing roller 2 is a driven belt support roller. The belt support roller 6 is rotatively driven such that the rotational direction of the belt support roller 6 (the clockwise direction in FIG. 14) is the same direction as the rotational direction of the fixing roller 2 (the clockwise direction in FIG. 14). The endless belt 10 will move in the opposite rotational direction as the fixing roller 2 in the nip region 10N of the endless belt 10.

More specifically, a driven gear 6G is arranged on the belt support roller 6 so as to rotate integrally therewith, and the driven gear 6G is meshed via an intermediate gear 16G with a drive gear 2G of the fixing roller 2. The other portions of this fixing device are substantially the same as those of the fixing device shown in FIG. 13, and thus a description thereof will be omitted.

In this embodiment, when the fixing roller 2 is rotatively driven in the clockwise direction in FIG. 14 by an electric motor M, the pressure roller 4 will be rotatively driven in the counterclockwise direction. At the same time, the belt support roller 6 will be rotatively driven in the same direction as the fixing roller 2 (the clockwise direction in FIG. 14), via the intermediate gear 16G meshed with the driven gear 2G of the fixing roller 2 and the driven gear 6G of the belt support roller 6 meshed with the intermediate gear 16G. As a result, the endless belt 10 will be rotatively driven in the same clockwise direction as the belt support roller 6, and the belt support roller 8 will be rotatively driven in the same clockwise direction via the endless belt 10. The endless belt 10 will move in the opposite rotational direction of the fixing roller 2 (the counterclockwise direction in FIG. 14) in the aforementioned nip region 10N.

For example, in the fixing device shown in FIG. 13, the endless belt 10 will normally move to the nip region 10N and heat the fixing roller 2 to a high temperature by means of the heating means 6H installed in the belt support roller 6. However, the heat in the nip region 10N will be absorbed by the surface of the fixing roller 2 and will reduce the temperature of the nip region 10N. This temperature reduction in the endless belt 10 will be larger when the surface of the fixing roller 2 has not been sufficiently warmed up during warm up time, and even if the width of the nip region 10N has been widened, the temperature increase gradient of surface of the fixing roller 2 will not significantly increase. However, with the fixing device shown in FIG. 14, because the endless belt 10 is configured so as to move in the opposite rotational direction as the fixing roller 2 in the nip region 10N, a fixed point on the surface of the fixing roller 2 will move in the nip region 10N in the direction in which the temperature of the endless belt 10 increases (toward the upstream side of the endless belt 10 and the belt support roller 8 in which the heating means 8H is installed). As a result, the speed at which the fixing roller 2 is warmed up can be increased. Thus, in the fixing device shown in FIG. 14, the warm up time can be further shortened because the ability to supply heat to the fixing roller is improved.

Note that even in the aforementioned embodiments configured such that the endless belt 10 moves in the nip region 10N in the same rotational direction as the fixing roller 2, when the peripheral speed of the endless belt 10 is set so as to be faster than the peripheral speed of the fixing roller 2, substantially the same effect as that described above can be obtained.

Embodiments of the Endless Belt

In each of the aforementioned fixing devices, the heat transmitted from the heat rollers to the endless belt 10 is preferably transferred to the fixing roller 2 as efficiently as possible. In order to achieve this goal, a preferred configuration is one which increases the surface area of the outer peripheral surface of the endless belt 10 that is in pressure contact with the surface of the fixing roller 2. In order to increase the surface area of the outer peripheral surface of the endless belt 10, a plurality of projections may be formed on the outer peripheral surface of a substantially flat endless belt 10. Embodiments of the endless belt 10 configured in this manner are schematically illustrated in FIGS. 15 to 23.

Figure 15:
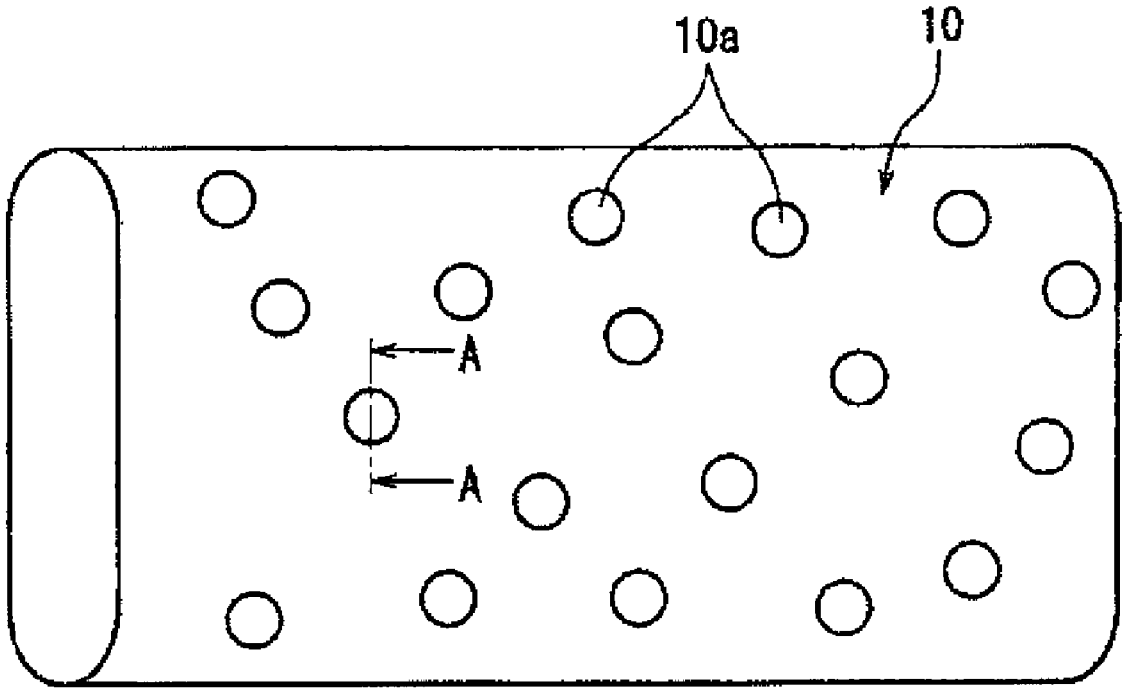
FIG. 15 is an oblique view schematically showing the configuration of an embodiment of an endless belt that forms a portion of a fixing device according to the present invention.
Figure 16:
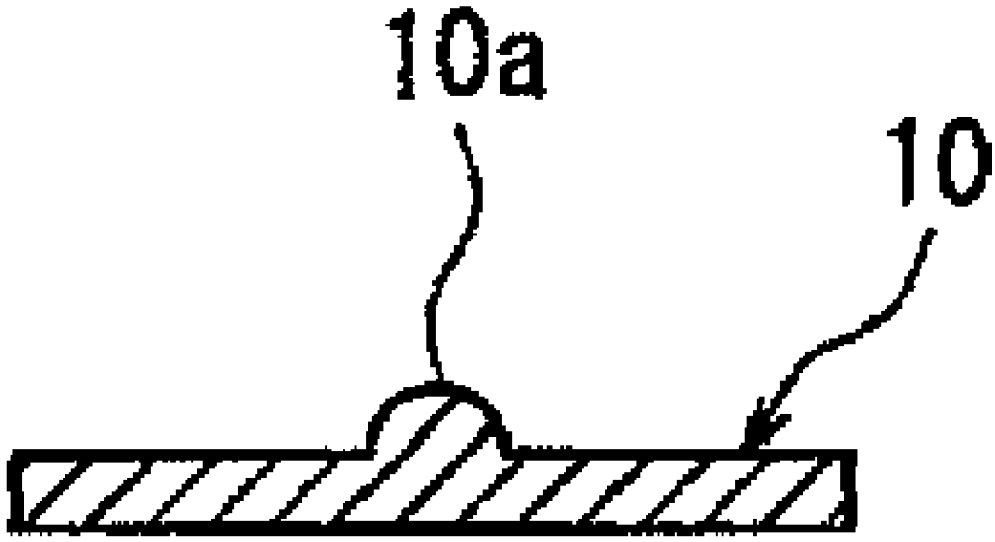
FIG. 16 is a cross-sectional view taken along line A-A of FIG. 15.

Referring to FIGS. 15 and 16, a plurality of projections 10*a* are formed in a spaced relationship on the outer peripheral surface of the endless belt 10. The outer peripheral surface of each projection 10*a* is curved (generally hemispherical). In the embodiment shown in FIG. 15, the projections 10*a* are irregularly arranged on the outer peripheral surface of the endless belt 10. However, they may be arranged in a pattern on the endless belt 10 in the circumferential and/or width directions.

Figure 17:
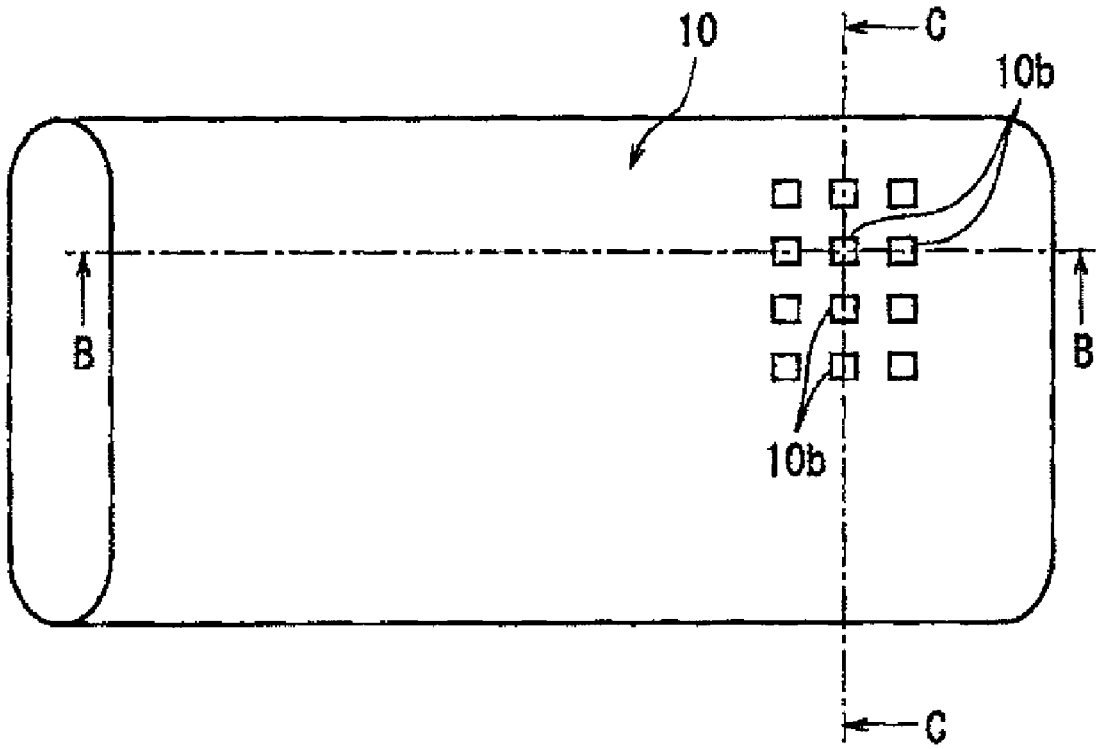
FIG. 17 is an oblique view schematically showing the configuration of another embodiment of an endless belt that forms a portion of a fixing device according to the present invention.
Figure 18:
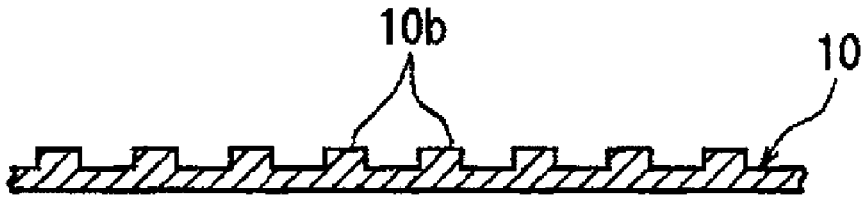
FIG. 18 is a cross-sectional view taken along line B-B of FIG. 17.
Figure 19:
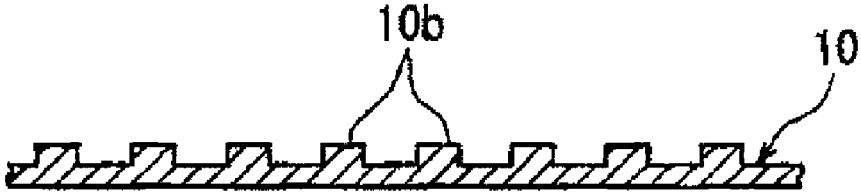
FIG. 19 is a cross-sectional view taken along line C-C of FIG. 17.

(b) Referring to FIGS. 17, 18 and 19, a plurality of projections 10*b* are formed in a spaced relationship on the outer peripheral surface of the endless belt 10. Each projection 10*b* is rectangular in cross-section, and are linearly arranged at a fixed spacing on the endless belt 10 in the circumferential direction and the width direction. In the embodiment shown in FIGS. 17 to 19, the projections 10*b* are arranged in a pattern on the outer peripheral surface of the endless belt 10. However, they may be irregularly arranged on the endless belt 10 in the circumferential and/or width directions.

Figure 20:
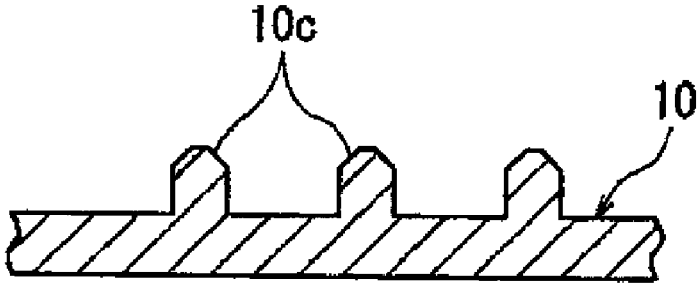
FIG. 20 is a cross-sectional view showing another embodiment of the projections formed on the endless belt shown in FIG. 17.

(c) In the embodiment shown in FIGS. 17 to 19, the projections 10*b* are rectangular in cross-section. However, as shown in FIG. 20, the edges of the apex of each of the projections 10*b* may be chamfered to produce projections 10*c* having no sharp edges on the apexes thereof. The shape of the chamfer in the projections 10*c* may be flat as shown in FIG. 20, or may be curved (not shown in the figures).

Figure 21:
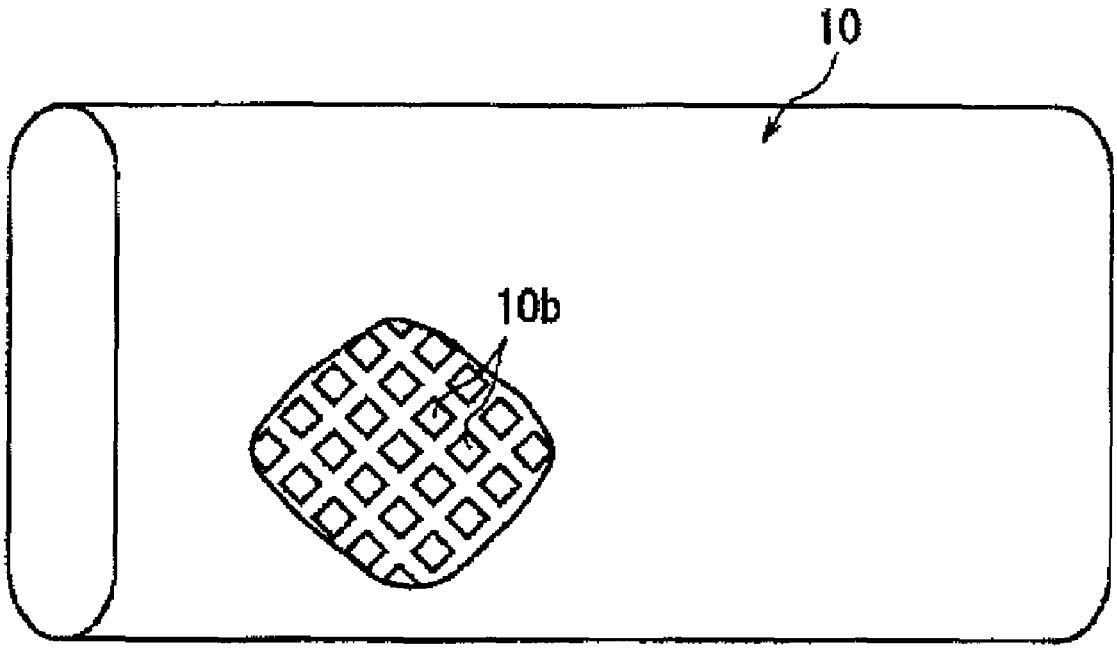
FIG. 21 is an oblique view schematically showing the configuration of yet another embodiment of an endless belt that forms a portion of a fixing device according to the present invention.

(d) In the embodiment shown in FIG. 21, each projection 10*b* is arranged at a fixed spacing along mutually perpendicular imaginary lines when viewed from the plane of the endless belt 10, with one imaginary line inclined in the width direction with respect to the circumferential direction of the endless belt 10, and the other imaginary line inclined in the circumferential direction with respect to the width direction of the endless belt 10. Each projection 10*b* is arranged on the plane in which the endless belt 10 extends, in a mesh pattern that is diagonally crossed with respect to the circumferential direction of the endless belt 10.

Figure 22:
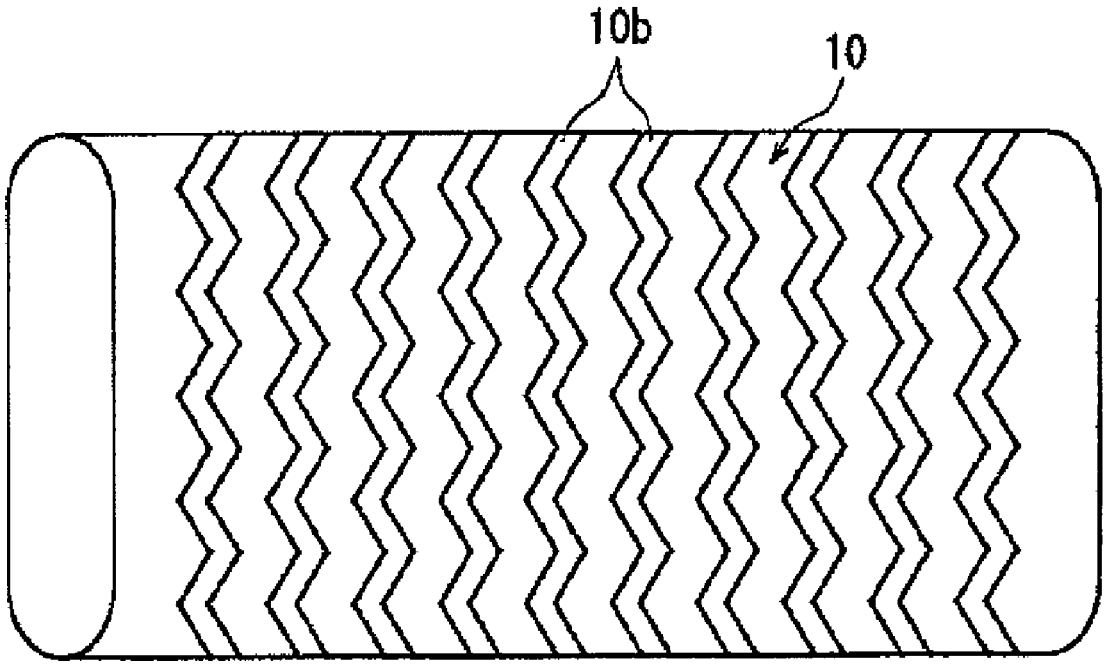
FIG. 22 is an oblique view schematically showing the configuration of yet another embodiment of an endless belt that forms a portion of a fixing device according to the present invention.

(e) In the embodiment shown in FIG. 22, each projection 10*b* is formed in a continuous zig-zag in the width direction of the endless belt 10, and in a spaced relationship in the circumferential direction of the endless belt 10.

Figure 23:
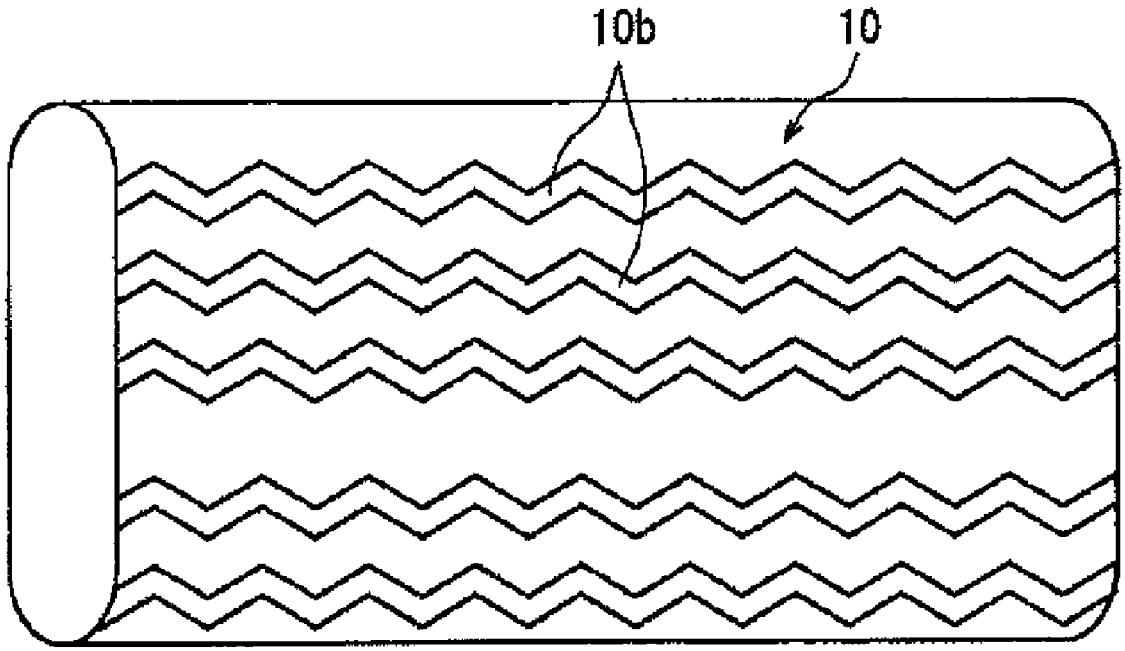
FIG. 23 is an oblique view schematically showing the configuration of yet another embodiment of an endless belt that forms a portion of a fixing device according to the present invention.

(f) In the embodiment shown in FIG. 23, each projection 10*b* is formed in a continuous zig-zag in the circumferential direction of the endless belt 10, and in a spaced relationship in the width direction of the endless belt 10.

As described above, by forming a plurality of projections 10*a*, 10*b*, 10*c*, or the like on the outer peripheral surface of the endless belt 10, the outer peripheral surface of the endless belt 10 having an increased surface area will be placed in pressure contact with the resilient surface of the fixing roller 2. More particularly, projections whose temperature is higher than that of other portions can be placed in contact therewith such that the projections are pushed into the surface of the fixing roller 2, the contact surface area of the endless belt 10 with respect to the fixing roller 2 can be increased, and thus the nip width of the endless belt 10 with respect to the fixing roller 2 can be substantially increased, and the heat accumulated on the endless belt 10 can be transmitted to the fixing roller 2 with good efficiency. As a result, the time needed to warm up the fixing roller 2 can be further shortened, and thus the total time needed to warm up the fixing device can be further shortened.

Note also that the cross-sectional shape and arrangement of the plurality of projections formed on the outer peripheral surface of the endless belt 10 are not limited in the aforementioned embodiments, and it goes without saying that various other combinations are possible.

EXAMPLES

The present inventors conducted comparative tests on the following three types of fixing devices in order to confirm the effects of the present invention. In the following three types of fixing devices, the fixing roller and the pressure roller are respectively composed of a core bar made of iron and having an outer diameter of 12.0 mm, the core bar is covered with a silicone sponge rubber that is 6.5 mm in thickness, an outer diameter of 25.0 mm, and an Asker-C hardness of 40°, and the surface of the silicone sponge rubber is covered with a PFA tube.

Comparative Example 1

The fixing device includes a fixing roller, a pressure roller that is in pressure contact with the fixing roller, and two heat rollers that are in pressure contact with the fixing roller and have heating means installed therein.

The two heat rollers that are in pressure contact with the surface of the fixing roller are each composed of a hollow tube made of aluminum having an outer diameter of 25.0 mm and a thickness of 0.5 mm, and the surface of the hollow tubes is coated with PFA. The heating means installed in each heat roller is a 500 W halogen heater. The amount of bite of each heat roller with respect to the outer peripheral surface of the fixing roller is 2.0 mm. The fixing roller is rotatively driven by an electric motor, and each heat roller is configured so as to be rotatively driven by the fixing roller.

Comparative Example 2

The fixing device includes a fixing roller, a pressure roller that is in pressure contact with the fixing roller, two belt support rollers that are mutually spaced apart from each other, and an endless belt that is wrapped around both of the belt support rollers. The two belt support rollers are mutually spaced apart from each other, and arranged on the upstream and downstream sides in the rotational direction of the fixing roller. A portion of the outer peripheral surface of the endless belt that extends between the two belt support rollers is in pressure contact with a portion of the outer peripheral surface of the fixing roller. The belt support roller on the upstream side is a heat roller having a heating means installed therein, and is in pressure contact with the fixing roller via the endless belt. The fixing roller is rotatively driven by an electric motor, and the aforementioned heat roller is configured so as to be rotatively driven by the fixing roller. The belt support roller on the downstream side is arranged across a gap from the outer peripheral surface of the fixing roller.

The belt support roller on the upstream side is a hollow tube made of aluminum having an outer diameter of 25.0 mm and a thickness of 0.5 mm. The heating means is a 1000 W halogen heater. The belt support roller on the downstream side is a hollow tube made of aluminum having an outer diameter of 20.0 mm and a thickness of 0.5 mm. The endless belt is made of a polyimide resin having a thickness of 90 micrometers. The amount of bite of the belt support roller on the upstream side with respect to the outer peripheral surface of the fixing roller (the amount of bite via the endless belt 10) is 1.0 mm.

Example 1

In a fixing device that has the same basic configuration as that of Comparative Example 1, the amount of bite of the belt support roller on the upstream side with respect to the outer peripheral surface of the fixing roller (the amount of bite via the endless belt 10) is 0.5 mm. In addition, a drive gear is arranged on the fixing roller 2 so as to rotate integrally therewith, and the fixing roller 2 is rotatively driven by engaging the drive gear with an electric motor. A driven gear is arranged on the belt support roller on the downstream side so as to rotate integrally therewith, and this driven gear is meshed with the drive gear on the fixing roller. The belt support roller on the downstream side is rotatively driven by the fixing roller, and the belt support roller on the upstream side is rotatively driven by the belt support roller on the downstream side via the endless belt 10. The endless belt is moved in the nip region of the endless belt in the same rotational direction as the fixing roller. This example is a fixing device having substantially the same configuration as the embodiment of the fixing device shown in FIG. 7.

The time needed to heat the fixing roller from 25 degrees C. to 160 degrees C. was as follows:

Comparative Example 1: 50.2 seconds

Comparative Example 2: 50.4 seconds

Example 1: 50.5 seconds

As is clear from the aforementioned experimental results, the warm up time in Example 1 is approximately the same as that of Comparative Examples 1 and 2. Although the warm up time is generally short, in order to achieve this type of warm up time in Comparative Example 1, the amount of bite each heat roller must have with respect to the outer peripheral surface of the fixing roller of 2.0 mm. A configuration having a large amount of bite will increase the localized burden on the fixing roller, and thus there will a strong likelihood that the durability of the fixing roller will be harmed.

Accordingly, comparative tests on the durability of the fixing rollers were performed. The results thereof are as follows:

Comparative Example 1: Wrinkles were produced in the paper after 10,000 copies.

Comparative Example 2: Wrinkles were produced in the paper after 100,000 copies. Damage such as deformation of the endless belt and the fixing roller was not observed.

Example 1: Wrinkles were produced in the paper after 300,000 copies. Damage such as deformation of the endless belt and the fixing roller was not observed.

As is clear from the aforementioned experimental results, wrinkles were produced in the paper in Comparative Example 1 comparatively soon. In other words, because the large amount of bite with respect to the outer peripheral surface of the fixing roller in Comparative Example 1 (2.0 mm), the torsion load in the rotational direction of the fixing roller during rotational driving will be high. Thus, it is believed that at a certain level of use, the sponge portion of the fixing roller will begin to break down (the sponge portion will be crushed), and by continuing to use the fixing roller, the outer diameter of the sponge portion will gradually change and make the transport force of the paper non-uniform, and wrinkles will be produced.

In Comparative Example 2, because a portion of the outer peripheral surface of the endless belt between the two belt support rollers is in pressure contact with a portion of the outer peripheral surface of the fixing roller, the amount of the aforementioned bite is 1.0 mm, less than that of the Comparative Example 1. Thus, the production of wrinkles in the paper occurs quite late, at a point 10 times greater than that of Comparative Example 1. In addition, damage such as deformation of the endless belt and the fixing roller was not observed. However, because the belt support roller on the upstream side (the heat roller) is configured so as to be rotatively driven by the fixing roller via the endless belt, it is believed that some slip will be produced in the nip region of the endless belt with respect to the fixing roller when a large number of copies are produced, and thus producing wrinkles in the paper.

In Example 1 having substantially the same configuration as the fixing device shown in FIG. 7, the belt support roller on the downstream side is rotatively driven by the fixing roller, and there is sufficient pressure contact between the fixing roller and the endless belt in the nip region of the endless belt. Thus, the amount of the aforementioned bite can be reduced to 0.5 mm, less than that of Comparative Example 2, therefore allowing the generation of slip in the nip region with respect to the fixing roller to be reliably prevented. Thus, because the endless belt is stably driven, the production of wrinkles in the paper was not observed even though the number of copies produced was 30 times that of Comparative Example 1 and 3 times that of Comparative Example 2. In addition, damage such as deformation of the endless belt and the fixing roller was not observed.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A heating transfer device of an image forming device for heating a heated medium in the image forming device, comprising:

a first rotation member including at least one heat generating element and plurality of projections, a first belt support roller and a second belt support roller mutually spaced apart from each other, and an endless belt wrapped around both the first and the second belt support rollers;

a control unit operatively arranged within the outer peripheral surface of the first rotation member; and a second rotation member having a surface arranged to contact the first rotation member at a first position, and the surface being arranged to contact the heated medium at a second position different from the first position, the plurality of projections contacting the second rotation member at the first position, the at least one heater being arranged in at least the first belt support roller and configured to heat the endless belt, the first belt support roller being in pressure contact with the second rotation member via the endless belt, a portion of an outer peripheral surface of the endless belt being in pressure contact with a portion of an outer peripheral surface of the second rotation member.

2. The heating transfer device according to claim 1, wherein the first rotation member being heated by the at least one heat generating element heats the surface of the second rotation member by contacting the plurality of projections of the first rotation member at the first position, and the second rotation member heats the heated medium by contacting the heated medium with the heated surface of the second rotation member at the second position.

3. The heating transfer device according to claim 1, wherein each of the plurality of projections is hemispherically shaped.

4. The heating transfer device according to claim 3, wherein the projections are irregularly arranged on the first rotation member.

5. The heating transfer device according to claim 1, wherein the control unit is arranged in a space defined by the endless belt and the first and the second belt support rollers.

6. The heating transfer device according to claim 5, wherein the control unit includes a thermistor in contact with one of the first and the second belt support rollers.

7. The heating transfer device according to claim 1, wherein each of the plurality of projections is rectangularly shaped.

8. The heating transfer device according to claim 7, wherein the projections are linearly arranged on the first rotation member.

9. The heating transfer device according to claim 7, wherein the projections are arranged in rows extending at an angle greater than zero degrees with respect to a width direction.

10. The heating transfer device according to claim 1, wherein the plurality of projections is formed in a continuous zig-zag in the width of the first rotation member.

11. The heating transfer device according to claim 1, wherein the plurality of projections is formed in a continuous zig-zag in the circumferential direction of the first rotation member.

12. The heating transfer device according to claim 1, wherein each apex of the plurality of projections is chamfered.

13. A heating transfer device of an image forming device for heating a heated medium in the image forming device, comprising:

a first rotation member including at least one heat generating element, first and second belt support rollers being mutually spaced apart from each other, an endless belt being wrapped around both the first and the second belt support rollers, and a plurality of projections, each of the plurality of projections having a substantially hemispherical shape; and a second rotation member having a surface arranged to contact the first rotation member at a first position, and the surface being arranged to contact the heated medium at a second position different from the first position, the plurality of projections contacting the second rotation member at the first position, the heat generating element being arranged in at least the first belt support roller and configured to heat the endless belt, the first belt support roller being in pressure contact with the second rotation member via the endless belt, wherein a portion of an outer peripheral surface of the endless belt is in pressure contact with a portion of an outer peripheral surface of the second rotation member.

14. A heating transfer device of an image forming device for heating a heated medium in the image forming device, comprising:

a first rotation member including at least one heat generating element, first and second belt support rollers being mutually spaced apart from each other, an endless belt being wrapped around both the first and the second belt support rollers, and a plurality of projections irregularly arranged on the first rotation member; and a second rotation member having a surface arranged to contact the first rotation member at a first position, and the surface being arranged to contact the heated medium at a second position different from the first position, the plurality of projections contacting the second rotation member at the first position, the heat generating element being arranged in at least the first belt support roller and configured to heat the endless belt, the first belt support roller being in pressure contact with the second rotation member via the endless belt, wherein a portion of an outer peripheral surface of the endless belt is in pressure contact with a portion of an outer peripheral surface of the second rotation member.

* * * * *